US005253941A

United States Patent [19]

Kamoda

[11] Patent Number: 5,253,941

[45] Date of Patent: Oct. 19, 1993

[54] TRANSFER/RECORDING PAPER CARTRIDGE

[75] Inventor: Hitoshi Kamoda, Kanagawa, Japan

[73] Assignee: Sony Corporation, Japan

[21] Appl. No.: 745,614

[22] Filed: Aug. 14, 1991

[30] Foreign Application Priority Data

Aug. 21, 1990 [JP] Japan ..... 2-219448
Aug. 21, 1990 [JP] Japan ..... 2-219449

[51] Int. Cl.[5] ..... B41J 35/28

[52] U.S. Cl. ..... 400/692; 400/208; 400/613

[58] Field of Search ..... 400/208, 611, 613, 624, 400/692; 271/162, 164

[56] References Cited

U.S. PATENT DOCUMENTS

| | | | |
|---|---|---|---|
| 4,775,138 | 10/1988 | Müller | 271/164 |
| 4,914,452 | 4/1990 | Fukawa | 400/207 |
| 4,917,513 | 4/1990 | Takanashi et al. | 400/613 |
| 4,998,714 | 3/1991 | Sparer et al. | 271/164 |
| 5,100,123 | 3/1992 | Kagiura et al. | 271/164 |

FOREIGN PATENT DOCUMENTS

| | | | |
|---|---|---|---|
| 203665 | 12/1986 | European Pat. Off. | 400/613 |
| 151367 | 7/1987 | Japan | 400/613 |
| 242669 | 10/1988 | Japan | 400/120 |
| 27977 | 1/1989 | Japan | 400/120 |
| 182626 | 7/1990 | Japan | 271/162 |

*Primary Examiner*—David A. Wiecking

*Attorney, Agent, or Firm*—Ronald P. Kananen

[57] ABSTRACT

A transfer/recording paper cartridge comprises: a case having a recording paper container containing recording papers, and a transfer paper container containing a feed spool on which is wound a transfer paper and a winding spool to which is fastened the leading end of the transfer paper, and provided with a paper feed opening; and a cover covering the paper feed opening. When a recording apparatus is loaded with the transfer/recording paper cartridge, the cover is moved automatically to an open position to open the paper feed opening so that the paper feed mechanism of the recording apparatus is able to gain access to the recording papers contained in the transfer/recording paper cartridge. The recording papers and the transfer paper are consumed proportionally, so that the recording papers and the transfer paper are exhausted simultaneously. A recording apparatus designed to use the transfer/recording paper cartridge comprises: a cover opening mechanism for automatically opening the cover of the transfer/recording paper cartridge when the same is loaded therein; a printing unit; and paper feed mechanism for feeding the recording paper from the transfer/recording paper cartridge to the printing unit. The recording papers and the pertinent transfer paper are handled always in combination and without being touched by fingers, and are exhausted simultaneously, so that nether the recording papers nor the transfer paper are wasted.

6 Claims, 25 Drawing Sheets

TRANSFER/RECORDING PAPER CARTRIDGE

BACKGROUND OF THE INVENTION

1. Field of Invention

The present invention relates to a novel transfer/-recording paper cartridge and a novel recording apparatus using the transfer/recording paper cartridge and, more specifically, to a novel transfer/recording paper cartridge capable of handling recording paper and retaining transfer paper in combination, of facilitating loading a recording apparatus with the recording paper and the transfer paper and removing the recording paper and the transfer paper from the recording apparatus, of facilitating storing the remnant recording paper and transfer paper, of avoiding the wrong combination of recording paper and transfer paper, feeding the recording paper in a wrong position and touching the recording paper with the fingers and the like and of being mounted on a recording apparatus at an appropriate position by an automatic cartridge loading mechanism, and to a recording apparatus using the transfer/-recording paper cartridge for recording.

2. Description of the Prior Art (FIG. 22)

In most recording operations of a recording apparatus, such as a printer, the ink of an inked transfer paper is transferred to a recording paper. In a video printer a shown in FIG. 22, as printing paper b is wound around a platen, not shown, an ink ribbon c is placed with an ink layer formed thereon in contact with the surface of the printing paper b, the printing paper b and the ink ribbon c are fed synchronously, and a thermal print head, not shown, is pressed against the ink ribbon c to transfer the ink from the ink ribbon c to the printing paper b for printing.

Also shown in FIG. 22 are a paper feed tray d containing printing papers b, and an ink ribbon cartridge e comprising a case f, a feed spool g carrying the coiled ink ribbon c and supported for rotation within the case f, and a winding spool h fixedly holding the leading end of the ink ribbon c and supported for rotation within the case f. The paper feed tray d containing the printing papers b is inserted detachably in a tray receiving unit i to load the paper feed unit of the video printer a with the printing papers b. The ribbon cartridge e is inserted in an ink ribbon receiving unit j to load the video printer a with the ink ribbon c.

A cartridge integrally having a transfer paper container and a recording paper container, and a printer designed for use such a cartridge are propose in, for example, U.S. Pat. No. 4,917,513 to facilitate changing the transfer paper and replenishing the recording paper container unit with recording papers.

Conventional recording apparatus, such as the video printer a, has the following disadvantages.

The printing papers b must be placed in the paper feed tray d beforehand, and all the printing papers b must be placed in the paper feed tray d with their right sides facing the right direction. Accordingly, the preparation for printing operation requires much troublesome work.

Generally, the printing surfaces of the printing papers b are finished by a chemical process and hence it is desirable to avoid soiling the printing surfaces with hand grease or the like. However, since the printing papers b are handled directly by hand, it is likely that the printing surfaces of the printing papers b will be soiled with hand grease causing incorrect printing.

The video printer a may be provided with malfunction preventive means capable of detecting the loading of the printing papers b on the video printer a with their printing surfaces facing in the wrong direction and for carrying out a predetermined procedure of avoiding malfunction to prevent incorrect printing. However, such malfunction preventive means increases the cost of the recording apparatus considerably.

A recording apparatus of such a kind must use recording papers and a transfer paper pertaining to the recording papers in combination; otherwise, the recording apparatus is unable to carry out the printing operation or, even if the recording apparatus could carry out the printing operation, the recording apparatus is unable to operate satisfactorily. Since the conventional recording apparatus is loaded separately with recording papers and a transfer paper, it is possible that the recording apparatus is loaded with recording papers and a transfer paper of the wrong combination. Particularly, if remnant recording papers are mixed in with recording papers of a different kind in storing the remnant recording papers, wrong recording papers are used in combination with a transfer paper.

SUMMARY OF THE INVENTION

To solve the foregoing problems, the present invention provides a transfer/recording paper cartridge comprising, in combination, a recording paper container containing recording papers, and a transfer paper container containing a feed spool on which is wound a transfer paper carrying an ink to be transferred to the recording paper and a winding spool to which is fastened the leading end of the transfer paper the cartridge including a cover for closing an opening formed in the recording paper container, which is moved to an open position to open the opening when the transfer/recording paper cartridge is inserted in a recording apparatus to enable paper feed means included in the recording apparatus to come into contact with the recording paper.

Furthermore, to solve the foregoing problems, the present invention provides a transfer/recording paper cartridge comprising, in combination, a recording paper container containing recording papers, and a transfer paper container containing a transfer paper feed spool on which is wound an inked transfer paper and a winding spool to which is fastened the leading end of the inked transfer paper, and which is provided with locking grooves capable of engaging locking members of a recording apparatus.

The transfer/recording paper cartridge in accordance with the present invention contains both recording papers of a predetermined kind and a transfer paper pertaining the the recording papers. Therefore, the recording apparatus can be loaded with both the recording papers piled with their right surfaces facing the right direction and the transfer paper simply by inserting the transfer/recording paper cartridge in the recording apparatus to complete the preparatory work very easily. Since at least the opening of the recording paper container is closed by the cover, the recording papers are protected from being touched by the fingers or the like, which enables handling the recording papers without particular attention. Since the recording papers and the transfer paper pertaining to the recording papers are handled always in correct combination, unsatisfactory printing attributable to wrong combination of recording papers and a transfer paper can surely be prevented. Since the remnant recording papers and the remnant transfer paper are always proportional, the recording papers and the transfer paper are not wasted.

Furthermore, since the transfer/recording paper cartridge is provided with the locking grooves that engage the locking members of the recording apparatus, the position of the transfer/recording paper cartridge relative to the moving member can be fixed, and hence the transfer/recording paper cartridge can automatically and correctly be placed at a predetermined position in the recording apparatus by the automatic loading mechanism including the moving member.

The present invention provides also a recording apparatus, which uses a transfer/recording paper cartridge integrally having a recording paper container containing recording papers and provided with an opening, a transfer paper container containing a feed spool on which is wound a transfer paper carrying an ink to be transferred to the recording paper and a winding spool to which is fastened the leading end of the transfer paper, and a cover closing the opening of the recording paper container, comprising: cover opening means for opening the cover, and paper feed means for feeding the recording paper to a printing unit. The cover opening means moves the cover to an open position to open the opening of the recording paper container in loading the recording apparatus with the transfer/recording paper cartridge to enable the paper feed means to come into contact with the recording paper.

Thus, the recording apparatus is able to perform the paper feed operation even if the transfer/recording paper cartridge is loaded thereon with its opening closed with the cover.

The present invention also provides a recording apparatus, which uses a transfer/recording paper cartridge comprising, in combination, a recording paper container containing recording papers, and a transfer paper container containing a transfer paper feed spool on which is wound a transfer paper and a winding spool to which is fastened the leading end of the transfer paper, and which is provided with locking grooves, comprising: a cartridge holder capable of detachably holding the transfer/recording paper cartridge where of moving between an ejecting position where the transfer/recording paper cartridge is inserted in and removed from the cartridge holder and a loading position where the transfer/recording paper cartridge is held in place, and provided with a lug to be pressed by the inserted transfer/recording paper cartridge; locking members for locking the transfer/recording paper cartridge on the cartridge holder; and moving means for moving the cartridge holder, in which the locking members engage the locking grooves formed in the transfer/recording paper cartridge where the moving means is driven to move the cartridge holder to the loading position while the cartridge holder is being pressed to move a predetermined distance by the inserted transfer/recording paper cartridge.

Thus, the recording apparatus of the present invention enables the transfer/recording paper cartridge to be placed where it can be removed from a predetermined position mechanically and very stably for satisfactorily reliable operation.

In a first aspect of the present invention, a transfer/recording paper cartridge comprises, in combination, a recording paper container containing recording papers, and a transfer paper container containing a transfer paper feed spool on which is wound an inked transfer paper and a winding spool to which is fastened the leading end of the inked transfer paper. The transfer/recording paper cartridge is provided with a cover for closing an opening formed in the recording paper container. When a recording apparatus is loaded with the transfer/recording paper cartridge, the cover is moved to an open position to open the opening of the recording paper container so that the paper feed means included in the recording apparatus is able to come into contact with the recording paper.

The transfer/recording paper cartridge enables handling recording papers and a pertaining transfer paper in combination, facilitates loading the recording papers and the transfer paper on and removing the same from the recording apparatus, facilitates storing remnant recording papers and transfer paper, protects the recording papers securely from being touched with the fingers and the like, and avoids the wrong combination of recording papers and transfer paper, and insertion of the recording papers in a wrong position into the recording apparatus.

In a second aspect of the present invention, a transfer/recording paper cartridge comprises, in combination, a recording paper container containing recording papers, and a transfer paper container containing a transfer paper carrying inks to be transferred to the recording papers, has locking grooves to engage the locking members of the recording apparatus, and is capable of being loaded in place on the recording apparatus by an automatic loading mechanism.

In a third aspect of the present invention, a recording apparatus designed to use the transfer/recording paper cartridge in accordance with the present invention comprises: cover opening means for opening the cover of the transfer/recording paper cartridge; and paper feed means for feeding the recording paper to a printing unit. The cover opening means opens the cover to open the opening of the recording paper container when the transfer/recording paper cartridge is loaded to enable the paper feed means to come into contact with the recording paper. Thus, the recording apparatus is able to feed the recording paper even if the transfer/recording paper cartridge is loaded on the recording apparatus without opening the cover.

In a fourth aspect of the present invention, a recording apparatus designed to use the transfer/recording paper cartridge in accordance with the present invention comprises: a cartridge holder capable of detachably holding the transfer/recording paper cartridge and of moving between an ejecting position where the transfer/recording paper cartridge is inserted in and removed from the cartridge holder and a loading position where the transfer/recording paper cartridge is held in place, and provided with a lug to be pressed by the inserted transfer/recording paper cartridge, locking members for locking the transfer/recording paper cartridge on the cartridge holder, and moving means for moving the cartridge holder.

The locking members engage the locking grooves formed in the transfer/recording paper cartridge to lock the transfer/recording paper cartridge on the cartridge holder and the moving means is driven to move the cartridge holder to the loading position while the cartridge holder is being pressed to move a predetermined distance by the inserted transfer/recording paper cartridge. Thus, the transfer/recording paper cartridge can mechanically and stably be loaded on the recording apparatus.

BRIEF DESCRIPTION OF THE DRAWINGS

The above and other objects, features and advantages of the present invention will become more apparent from the following description taken in connection with the accompanying drawings, in which:

FIGS. 1 to 7 show a transfer/recording paper cartridge in a first embodiment according to the present invention as applied to a ribbon/printing paper cartridge for a video printer, in which:

FIG. 1 is a perspective view of the ribbon/printing paper cartridge with a ribbon feed spool stored in a spool chamber, FIG. 2 is a perspective view of the ribbon/printing paper cartridge with the ribbon feed spool taken out from the spool chamber, FIG. 3 is an exploded perspective view, FIG. 4 is a plan view, FIG. 5 is an enlarged sectional view taken on line V—V in FIG. 4, FIG. 6 is an enlarged sectional view taken on line VI—VI in FIG. 4, and FIG. 7 is an enlarged sectional view taken on line VII—VII in FIG. 4;

FIGS. 8 to 15 show a recording apparatus embodying the present invention as applied to a video printer designed for use in combination with the ribbon/printing paper cartridge of FIGS. 1 to 7, in which:

FIG. 8 is a general plan view,

FIG. 9 is a perspective view of an essential portion,

FIG. 10 is a central, longitudinal sectional view of the video printer in the initial state, FIG. 11 is a central, longitudinal sectional view of the video printer in the home position, FIG. 12 is a central, longitudinal sectional view of the video printer in the printing state, FIG. 13 is an exploded perspective view of a cartridge holder and part of a cartridge holder driving mechanism, FIG. 14 is an enlarged plan view of an ink ribbon feed mechanism.

FIGS. 16 to 21 show a transfer/recording paper cartridge in a second embodiment according to the present invention as applied to a ribbon/printing paper cartridge, in which:

FIG. 16 is a general perspective view,

FIG. 17 is a plan view,

FIG. 18 is an enlarged sectional view taken on line XVIII—XVIII in FIG. 17, FIG. 19 is an enlarged sectional view taken on line XIX—XIX in FIG. 17, FIG. 20 is an enlarged sectional view taken on line XX—XX in FIG. 17, and FIG. 21 is an enlarged sectional view taken on line XXI—XXI in FIG. 17.

DETAILED DESCRIPTION OF THE PREFERRED EMBODIMENTS

Figure 1:
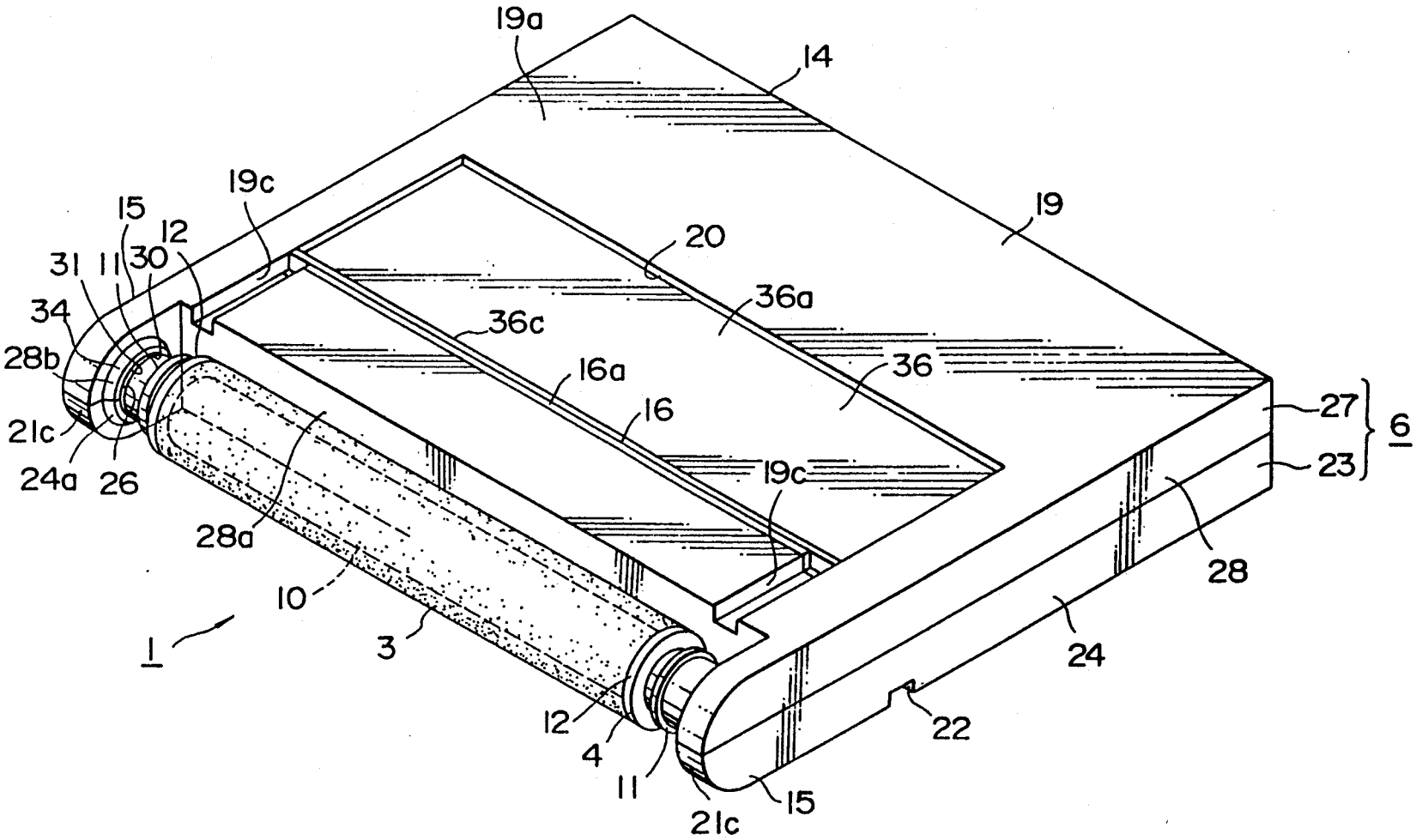

A transfer/recording paper cartridge and a recording apparatus embodying the present invention will be described hereinafter with reference to the accompanying drawings.

The present invention will be described as applied to a ribbon/printing paper cartridge and to a video printer designed to use the ribbon/printing paper cartridge.

Ribbon/Printing Paper Cartridge in a First Embodiment (FIGS. 1 to 7)

The ribbon/printing paper cartridge 1 comprises: a plurality of printing papers 2, a ribbon feed spool 4, a ribbon winding spool 5, an ink ribbon 3 wound on the ribbon feed spool 4 and having a leading end fixed to the ribbon winding spool 5, and a case 6 having a printing paper chamber containing the printing papers 2 and a ribbon chamber containing the spools 4 and 5.

Printing Paper (FIGS. 2 to 5)

The printing papers 2 have a rectangular shape and a printing surface finished by a chemical process so as to interact with the inks of the ink ribbon 3 and develop colors. The predetermined number of printing papers 2 are contained in a pile in the printing paper chamber of the case 6.

Ink Ribbon (FIGS. 1 to 7)

The ink ribbon 3 comprises a long base film 8 formed of a synthetic resin, and a plurality of ink layers 9 of sublimable inks formed on one surface of the base film 8 in a successive arrangement along the longitudinal direction of the base film 8 at regular intervals. The ink layers 9 have a rectangular shape of a size slightly smaller than that of the printing papers 2. The ink layers 9 contain coloring matters that develop cyan, magneta and yellow, respectively. A predetermined number of sets each of three different ink layers 9 arranged in predetermined order are arranged successively on the base film 8. The number of sets of ink layers 9 is equal to that of the printing papers 2.

The ink ribbon 3 is wound on the ribbon feed spool 4 and the leading end of the ink ribbon 3 is fixed to the ribbon winding spool 5.

Each of the ribbon feed spool 4 and the ribbon winding spool 5 has a spindle 10 of a length a little greater than the width of the ink ribbon 3, a pair of outer flanges 11 formed at the opposite ends of the spindle 10, and a pair of inner flanges 12 formed a little inside the outer flanges 11, respectively, and having a diameter a little greater than that of the outer flange 11. Each of the ribbon feed spool 4 and the ribbon winding spool 5 is formed of a synthetic resin in an integral part. In the following description, "right" refers to the lower right-hand side, "left" refers t the upper left-hand side, "front" refers to the lower left-hand side, "back" refers to the upper right-hand side, "longitudinal" refers to the direction from the front to the back or from the back to the front, and "lateral" refers to the direction perpendicular to the longitudinal direction as viewed in FIG. 1. Gears 13 are formed on the right-hand ends of the spindles 10 of the ribbon feed spool 4 and the ribbon winding spool 5, respectively.

The ink ribbon 3 is wound on the spindle 10 of the ribbon feed spool 4 between the inner flanges 12 with the ink layers 9 facing inside and the leading end of the ink ribbon 3 is fixed to a portion of the spindle 10 between the inner flanges 12 of the ribbon winding spool 5.

Case (FIGS. 1 to 7)

The thickness of the case 6 is about twice the thickness of the pile 7 of the printing papers 2. The case 6 has a main body 14 having the shape of a box having laterally extending longer sides, parallel, hollow arms 15 projecting to the front from the front end of the main body 14, and partition walls 16 partitioning the interior of the main body 14 into a printing paper chamber 17 and a spool chamber 18. A paper feed opening 20 is formed in the top wall 19 of the main body 14 in an area corresponding to the printing paper chamber 17. Locking grooves 22 are formed respectively in the outer surface of the lateral sides of the bottom wall 21 of the main body 14 so as to engage the locking levers of a printer, which will be described later. The pile 7 of printing papers is contained in the printing paper chamber 17, the ribbon winding spool 5 is supported for rotation within the spool chamber 18. The ribbon feed spool 4 is supported detachably on spool holders, which will be described later, provided on the two arms 15, respectively.

The case of such a construction is formed by joining upper and lower half cases each of which is formed of a synthetic resin in an integral part.

Lower Half Case

The lower half case 23 has a bottom wall 21, a peripheral wall 24, an inner wall 16 and two parallel spool support walls 25.

The bottom wall 21 has a main portion **21*a* having a rectangular shape of a size a little greater than that of the printing papers 2, and projections 21*c* projecting from the lateral ends of the front edge 21*b* of the main portion 21*a*, respectively. The length of the projections 21*c* is a little greater than the maximum diameter of the roll of the ink ribbon 3 wound on the spindle 10 of the ribbon feed spool 4. The lower portions of the front ends of the projections 31*c* are rounded substantially in the shape of an arc of a circle. The distance between the inner surfaces of the two projections 21*c* is a little greater than the axial length of the ribbon feed spool 4**.

The middle portion of the front section of the peripheral wall 24 standing upright from the front edge **21*b* of the bottom wall 21 is recessed. Substantially semicircular recesses 26 opening upward are formed in end portions of the front section of the peripheral wall 24 merging into the projections 21*c*. Conical flanges 24*a* are formed along the rims of the substantially semicircular recesses 26** so as to project inward.

The inner wall 16 has a front section **16*a* standing upright from the bottom wall 21 at a position a little behind the front edge 21*b* of the bottom wall 21, and parallel lateral sections 16*b* extending backward from the opposite ends of the front section 16*a*, respectively. The height of the front section 16*a* of the inner wall 16 is about twice that of the peripheral wall 24. The opposite ends of the front section 16*a* of the inner wall 16 are separated slightly from the corresponding sections of the peripheral wall 24. The height of the lateral sections 16*b* of the inner wall 16 is slightly greater than that of the peripheral wall 24. The rear ends of the lateral sections 16*b* of the inner wall 16 are joined to the back section of the peripheral wall 24**.

A slot **21*d* is formed in the right-hand end of a front section of the main portion 21*a* of the bottom wall 21 extending to the front from the front section 16*a* of the inner wall 16 to receive the gear 13 of the ribbon winding spool 5. The width of the slot 21*d* is slightly greater than the tooth width of the gear 13 of the ribbon winding spool 5**.

A portion of the bottom wall 21 surrounded by the inner wall 16 and the back section of the peripheral wall 24 forms the bottom wall **21*e* of the printing paper chamber 17. A front section of the same portion 21*e* about two parts back from the front section 16*a* of the inner wall 16 is elevated to form an elevated section, a longitudinally elongate slot 21*f* is formed in the elevated section at the middle with respect to the lateral direction, and laterally elongate slots 21*g*** are formed at the opposite lateral ends of the back portion of the elevated portion, respectively.

The two parallel spool support walls 25 are formed respectively near the opposite lateral ends of a portion of the bottom wall 21 extending to the front from the front section **16*a* of the inner wall 16. The height f the spool support walls 25 is equal to that of the peripheral wall 24. Substantially semicircular recesses 25*a* are formed in the upper edges of the spool support walls 25**, respectively.

The locking grooves 22 are formed in the outer surface of the bottom wall 21 at positions behind the front section **16*a* of the inner wall 16 in the opposite lateral ends of the portion 21*e* of the bottom wall 21**.

Upper Half Case

The upper half case 27 has a top wall 19, a peripheral wall 28 extending downward from the periphery of the top wall 19, and two spool support walls 29. The size of the main portion **19*a* of the top wall 19 is equal to that of the main portion 21*a* of the bottom wall 21. The size in top plan view of projections 19*b* projecting to the front from the opposite ends of the front edge of the main portion 19*a* is equal to the corresponding size of the projections 21*c* of the bottom wall 21. The front ends of the projections 19*b* are bent down in the shape of an arc of a circle. The height of the peripheral wall 28 excluding a front section 28*a* extending from the front edge of the main portion 19*a* of the top wall 19 is substantially equal to that of the peripheral wall 24 of the lower half case 23. The height of the front section 28*a* is slightly greater than the other sections of the peripheral wall 28**.

Semicircular recesses 30 are formed in the lower edges of side walls extending downward from the inner edges of the projections **19*b* of the peripheral wall 28, respectively. Conical flanges 28*b* are formed along the inner rims of the semicircular recesses 30**, respectively.

The paper feed opening 20 is formed in the top wall 19 in an area corresponding to the front section of the elevated portion **21*e* of the bottom wall 21. The size of the laterally elongate, rectangular paper feed opening 20 with respect to the longitudinal direction is about half the size of the printing papers 2** with respect to the feed direction.

Longitudinal grooves **19*c* are formed at the opposite lateral ends of a front section of the top wall 19 extending to the front from the paper feed opening 20. The front ends of the grooves 19*c* open in the front section of the peripheral wall 28, and the back ends of the same open into the paper feed opening 17**.

The spool support walls 29 are formed on the top wall 19 at positions corresponding respectively to the spool support walls 25 of the lower half case 23. Semicircular recesses **29*a* are formed in the lower edges of the spool support walls 29**.

Assembly

The lower half case 23 and the upper half case 27 are joined together with the upper edge of the peripheral wall 24 and the lower edge of the peripheral wall 28 in contact with each other and with the upper edge of the front section 16*a* of the inner wall 16 in contact with the front edge of the paper feed opening 20, and then the lower half case 23 and the upper half case 27 are fastened together with fastening means, not shown.

The main portion 21*a* of the bottom wall 21, the main portion 19*a* of the top wall 19, and the peripheral walls 24 and 28 form a main body 14 having the shape of a comparatively thin box. The projections 21*c* of the bottom wall 21, sections of the peripheral wall 24 corresponding to the edges of the projections 21*c*, the projections 19*b* of the top wall 19, and the sections of the peripheral wall 28 corresponding to the edges of the projections 19*b* form the hollow arms 15 having a shape substantially resembling the letter U in side view. The printing paper chamber 17 defined by the inner wall 16 and the back sections of the peripheral walls 24 and 28, and the laterally elongate spool chamber 18 are formed in the main body 14. Circular holder receiving holes 31 are formed coaxially with the inner side walls of the arms 15 by the recesses 26 and 30. Parallel walls 32 are formed by the spool support walls 25 and 29, and coaxial circular support holes 33 are defined in the walls 32 by the recesses 25*a* and 29*a*.

Annular projections 34 having a conical outer surface are formed around the inner edges of the holder receiving holes 31 by the conical flanges 24*a* and 28*b*.

A laterally elongate ink ribbon outlet 35 is formed at the lower end of the front wall of the main body 14 in a range corresponding to the space in the spool chamber 18 between the two walls 32. Therefore, the spool chamber 18 is opened to the front in the ink ribbon outlet 35 and opens downward in the slot 31*d*.

Cover (FIGS. 1 to 5)

The paper feed opening 20 is covered with a cover 36.

The cover 36 has a main portion 36*a* having the shape of a plate of a size greater than the paper feed opening 20, side legs 36*b* extending downward respectively from the opposite lateral ends of the main portion 36*a*, and a flange 36*c* projecting upward from the front edge of the main portion 36*a*. spring pegs 37 are attached to the rear portions of the side legs 36*b* so as to project outward. The cover 36 is formed of a synthetic resin in an integral part.

The cover 36 is combined with the lower half case 23 so that the side legs 36*b* are in sliding contact with the outer surfaces of the lateral sections 16*b* of the inner wall 16, and the main portion 36*b* is in sliding contact with the upper edges of the lateral sections 16*b* of the inner wall 16, respectively.

Figure 2:
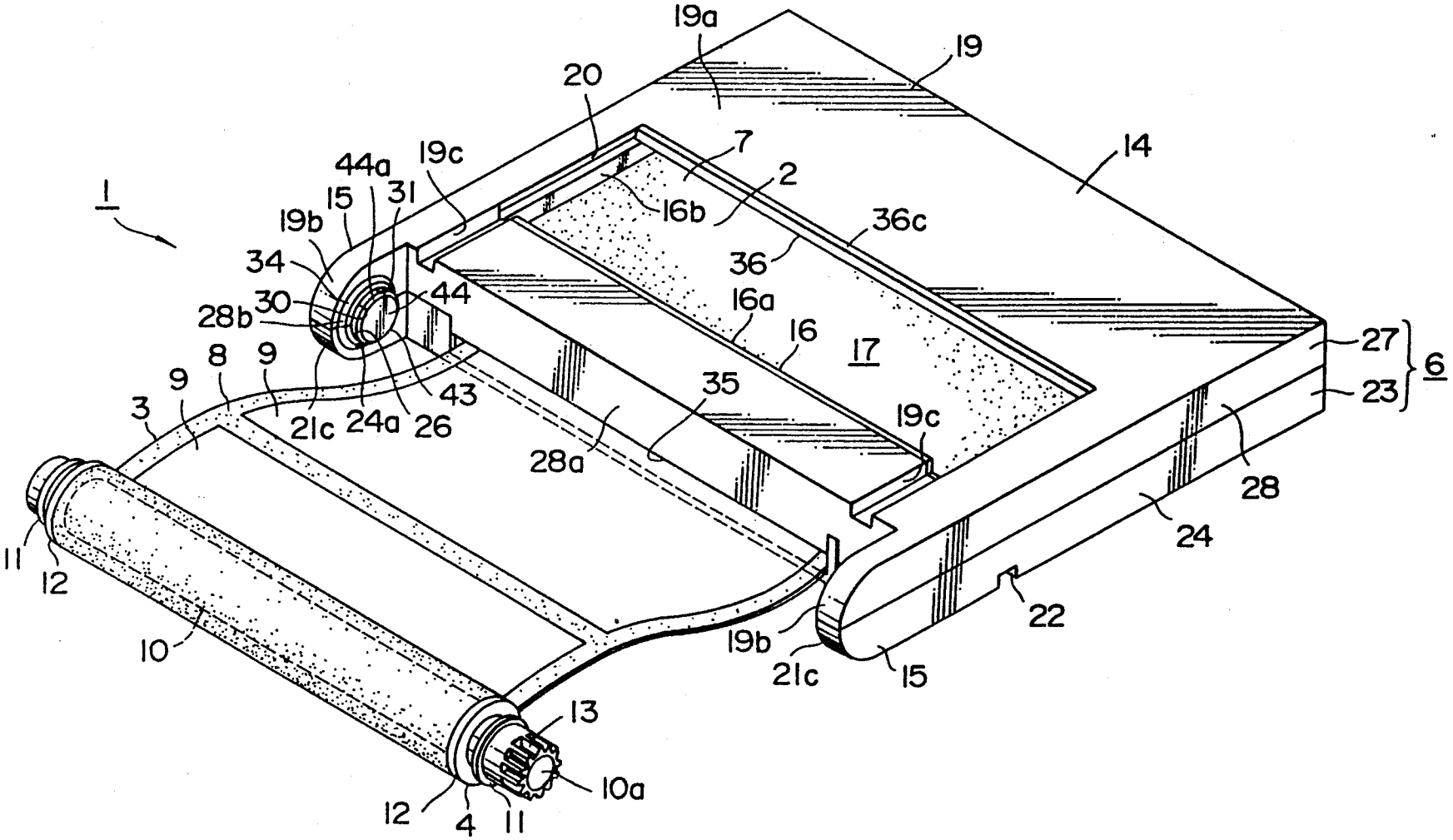

The cover 36 can be moved between a closed position where the main portion 36*a* is in contact with the front section 16*a* of the inner wall 16 to close the paper feed opening 20 as shown in FIG. 1, and an open position where the flange 36*c* is in contact with the back edge of the paper feed opening 20 to open the paper feed opening 20 as shown in FIG. 2.

Extension springs 38 each have a front end held by a spring peg attached to the lower half case 23, and a back end held by the spring peg 37 attached to the cover 36. The cover 36 is biased to the front by the extension springs 38 to keep the cover 36 at the closed position unless the cover 36 is pushed backward.

Figure 3:
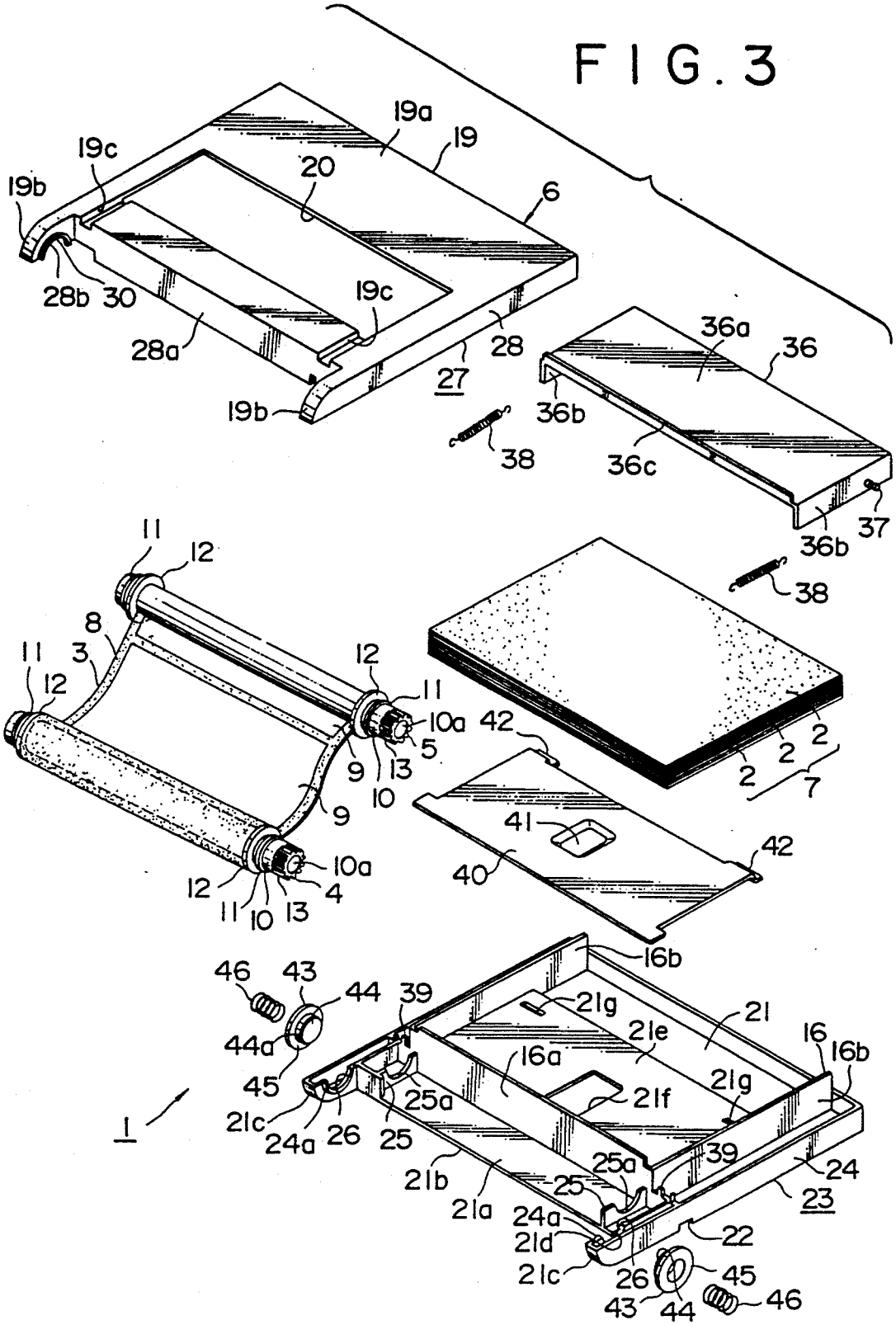
Figure 4:
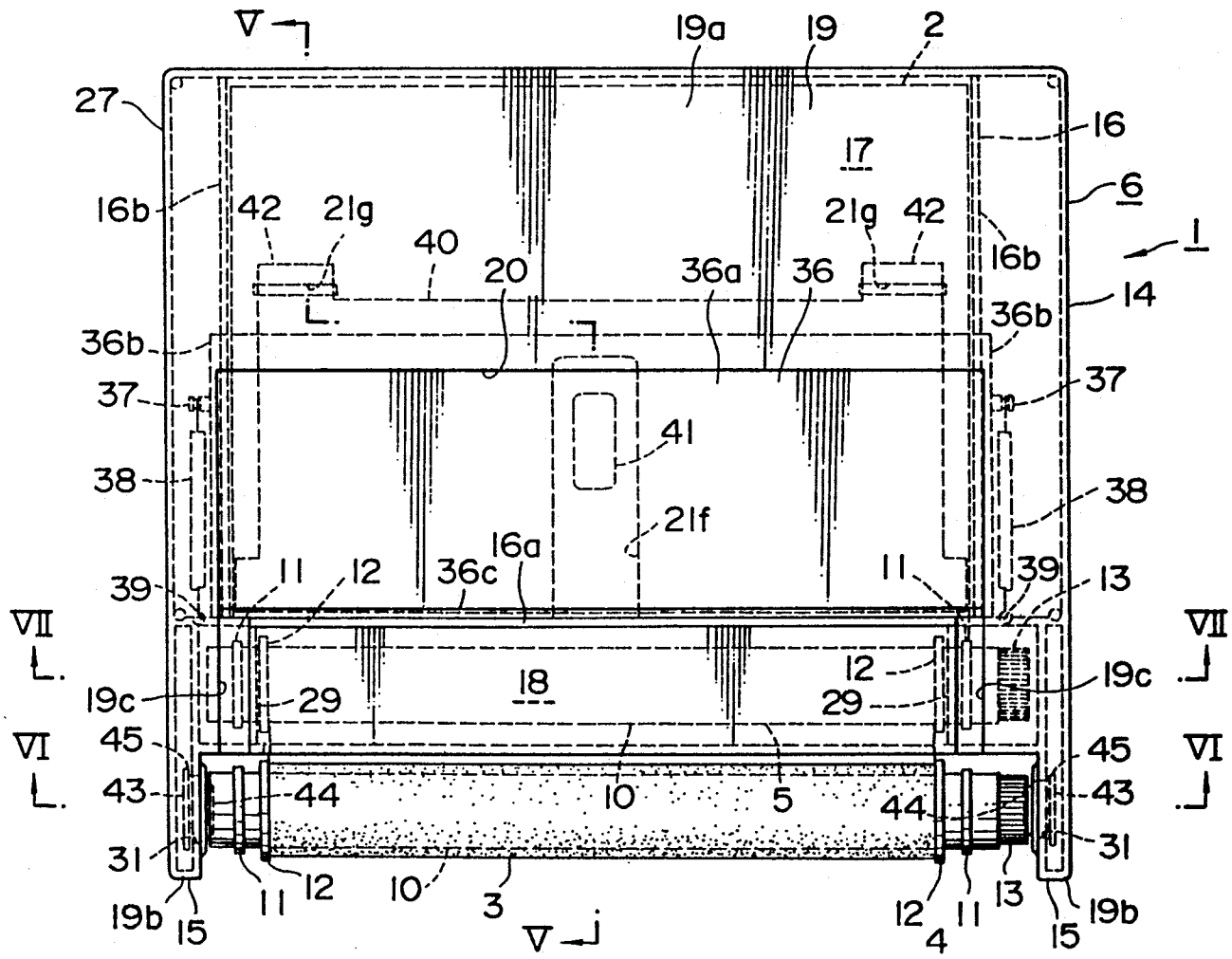
Figure 5:
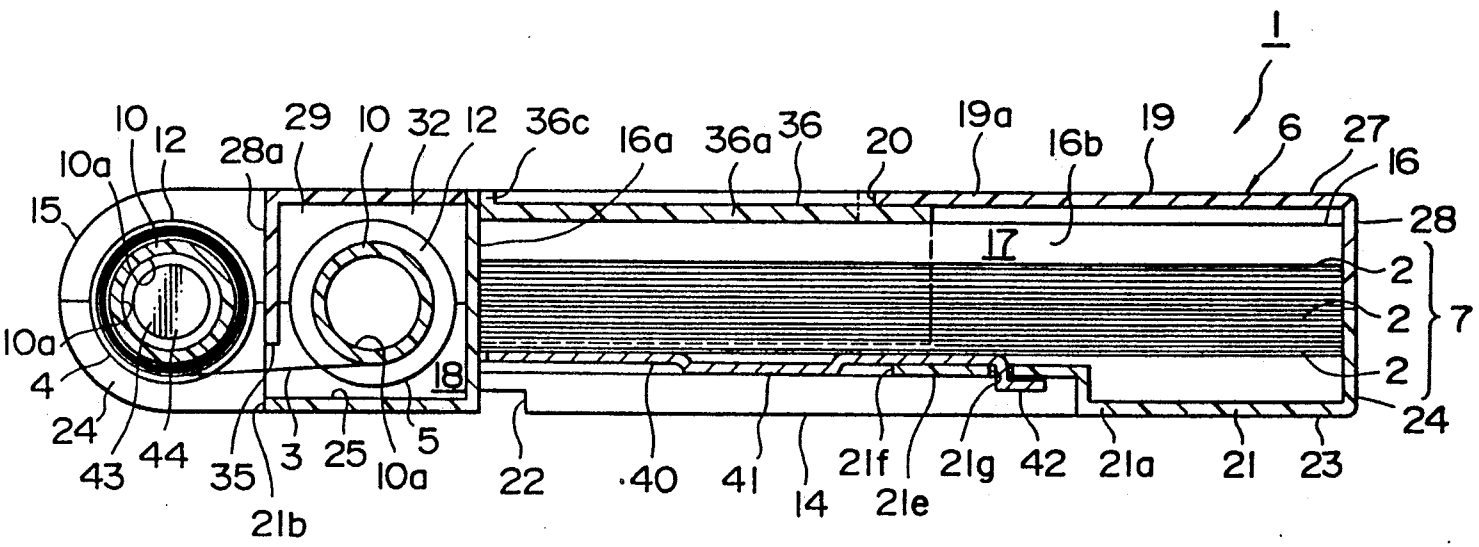

Paper Lifting Plate and Printing Paper Storage (FIGS. 3 to 5)

A paper lifting plate 40 is a metal plate having substantially rectangular shape of a size slightly greater than that of the elevated portion 21*e* of the bottom wall of the printing paper chamber 17. A downward protrusion 41 is formed by pressing in the central portion of the paper lifting plate 40. Knuckles 42 of an L-shaped cross section are formed at the opposite lateral ends of the rear edge of the paper lifting plate 40. The knuckles 42 engage loosely the slots 21*g* formed in the elevated portion 21*e* of the bottom wall of the lower half case 23, respectively, so that the paper lifting plate 40 is able to swing vertically on the knuckles 42 in the printing paper chamber 17.

The pile 7 of printing papers 2 is mounted on the paper lifting plate 40 In the printing paper chamber 17.

Supporting Spools (FIGS. 1 to 7)

The ribbon winding spool 5 is supported for rotation in the spool chamber 18 with a left-hand portion of the spindle 10 of the ribbon winding spool 5 between the left-hand outer flange 11 and the left-hand inner flange 12, and a right-hand portion of the same between the right-hand outer flange 11 and the right-hand inner flange 12 received in the support holes 33 formed in the walls 32.

The gear 13 of the ribbon winding spool 5 is received partly in the slot 21*d*. The ink ribbon 3 fastened to the ribbon winding spool 5 extends through the ink ribbon outlet outside the main body 14.

Spool holders 43 for holding the ribbon feed spool 4 have a large diameter relative to their thickness. Each spool holder 43 has a tubular holding boss 44 having one end open and the other end closed, and a flange 45 formed at the open end of the holding boss 44. The outer half of the holding boss 44 is tapered to a diameter slightly smaller than the inside diameter of the corresponding bore 10*a* of the spindle 10 of the ribbon feed spool 4 to form a taper portion 44*a*.

Figure 6:
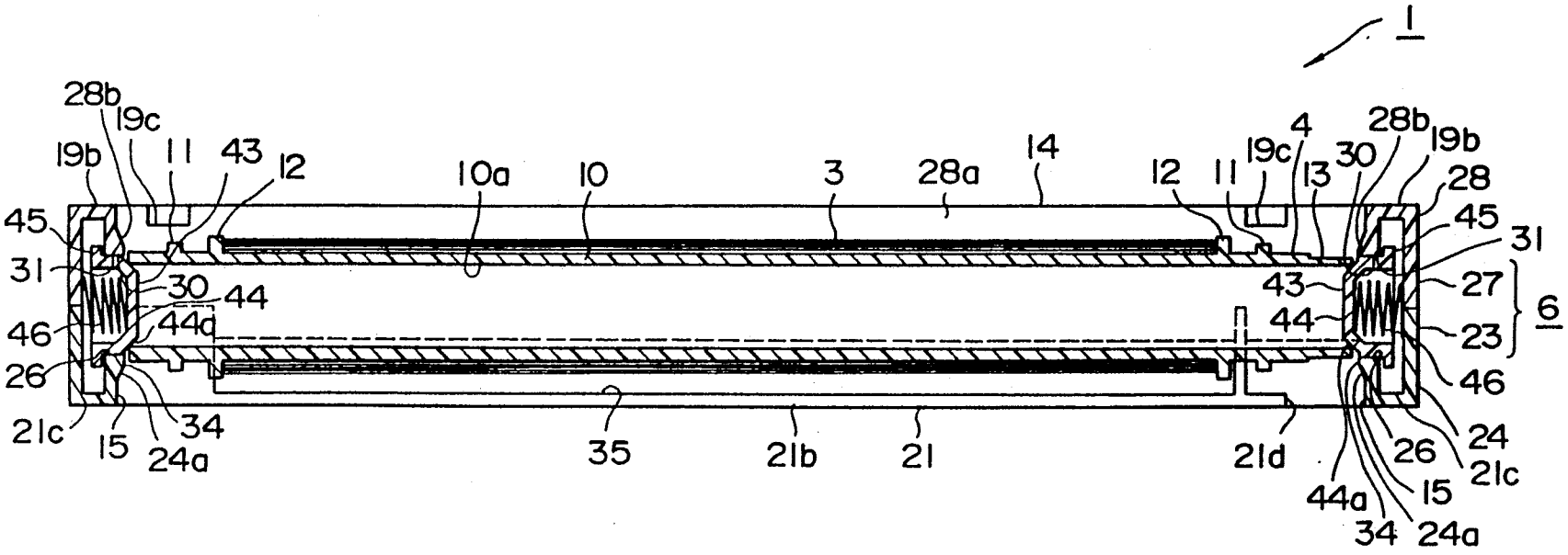
Figure 7:
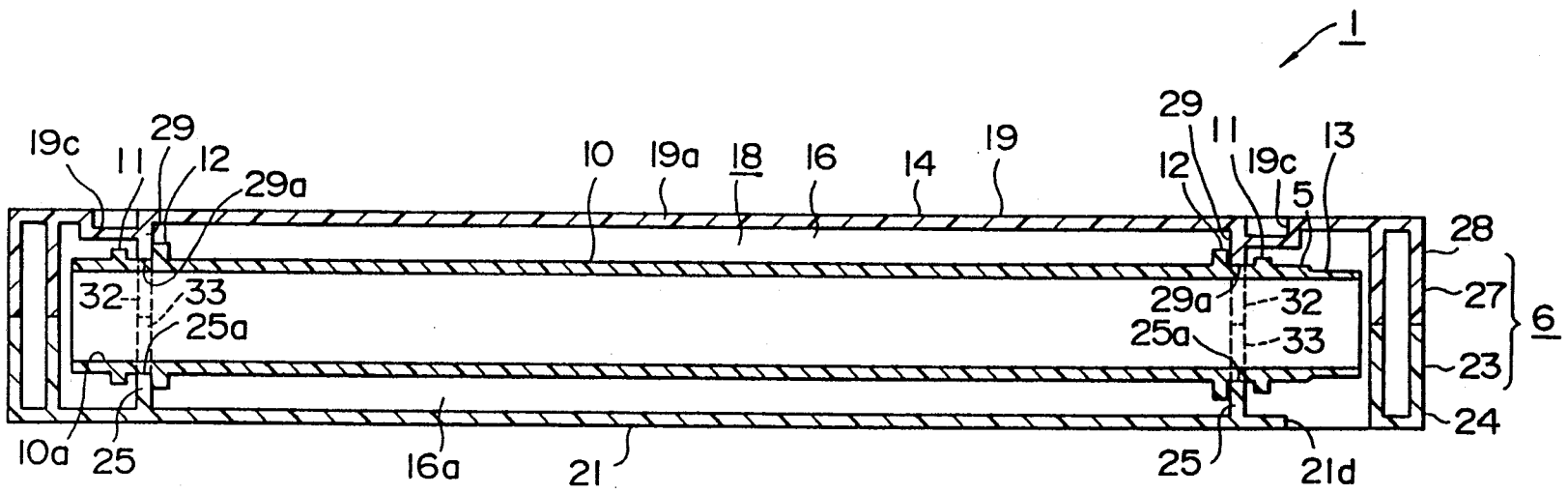

As shown in FIG. 6, the holding bosses 44 of the spool holders 43 are inserted axially slidably in the holder receiving holes 31 of the arms 15 so as to project inward. The spool holders 43 are biased toward each other by compression coil springs 46 placed between the outer walls of the arms 15 and the end walls of the holding bosses 44, respectively. The axially inward movement of the spool holders 43 is limited by the engagement of the flanges 45 with the edges of the holder receiving holes 31. In a free state, the taper portions 44*a* of the holding bosses 44 project inward through the holder receiving holes 31.

The taper portions 44*a* of the spool holders 43 are fitted in the opposite ends of the bore 10*a* of the spindle 10 of the ribbon feed spool to support the ribbon feed spool 4 on the arms 15. In supporting the ribbon feed spool 4 on the arms 15, the opposite ends of the spindle 10 are pressed against the taper portions 44*a* of the spool holders 43 in a direction perpendicular to the axis thereof. Then, the spool holders 43 are pushed temporarily into the arms 15 by the spindle 10, and then the taper portions 44*a* are pushed into the bore 10*a* of the spindle 10 upon the coincidence of the free ends of the taper portions 44*a* with the bore 10*a* of the spindle 10.

The ink ribbon 3 has a leading portion of an appropriate length provided with no ink layer extending from the ribbon winding spool 5. In loading the spools 4 and 5, the leading portion is taken up on the ribbon winding spool 5.

Function

The ribbon/printing paper cartridge 1 loaded with the ribbon feed spool 4 is inserted in the printer, which will be described later. Then, the printer opens the cover 6, takes out the ribbon feed spool 4 from the case 6, and threads the ink ribbon 3.

Thus, the loading of the printing papers 2 and the ink ribbon 3 on the printer is completed simply by inserting the ribbon/printing paper cartridge 1 in the printer and hence the printing papers 2 and the ink ribbon 3 are not handled directly by hand. Accordingly, the printing papers 2 and the ink ribbon 3 are never soiled or damaged, the printing papers 2 and the ink ribbon 3 pertaining to the printing papers 2 are handled in combination eliminating the wrong combination of printing papers and an ink ribbon, and the printing papers 2 and the ink ribbon 3 are consumed proportionally, so that the printing papers 2 and the ink ribbon 3 are exhausted simultaneously. The ribbon/printing paper cartridge 1 facilitates storing the remnant printing papers 2 and the ink ribbon 3 and avoids the mixing of different kinds of printing papers.

Video Printer (FIGS. 8 to 15)

FIGS. 8 to 15 show a recording apparatus in accordance with the present invention as embodied in a video printer 47 designed to use the ribbon/printing paper cartridge 1.

General Description (FIGS. 8 to 12)

The video printer 47 (only essential portions of the mechanisms thereof are shown in the drawings) has a cartridge loading mechanism 48 for setting the ribbon/-printing paper cartridge 1 in place and ejecting the same from the video printer 47, a printing unit 49 for processing the printing paper 2 for printing, a paper feed mechanism 50 for feeding the printing paper 2 to the printing unit 49, a ribbon loading mechanism 51 for loading the printing unit 49 with the ink ribbon 3, and an ink ribbon feed mechanism 52 for driving the ribbon winding spool 5 to feed the ink ribbon 3.

Figure 8:
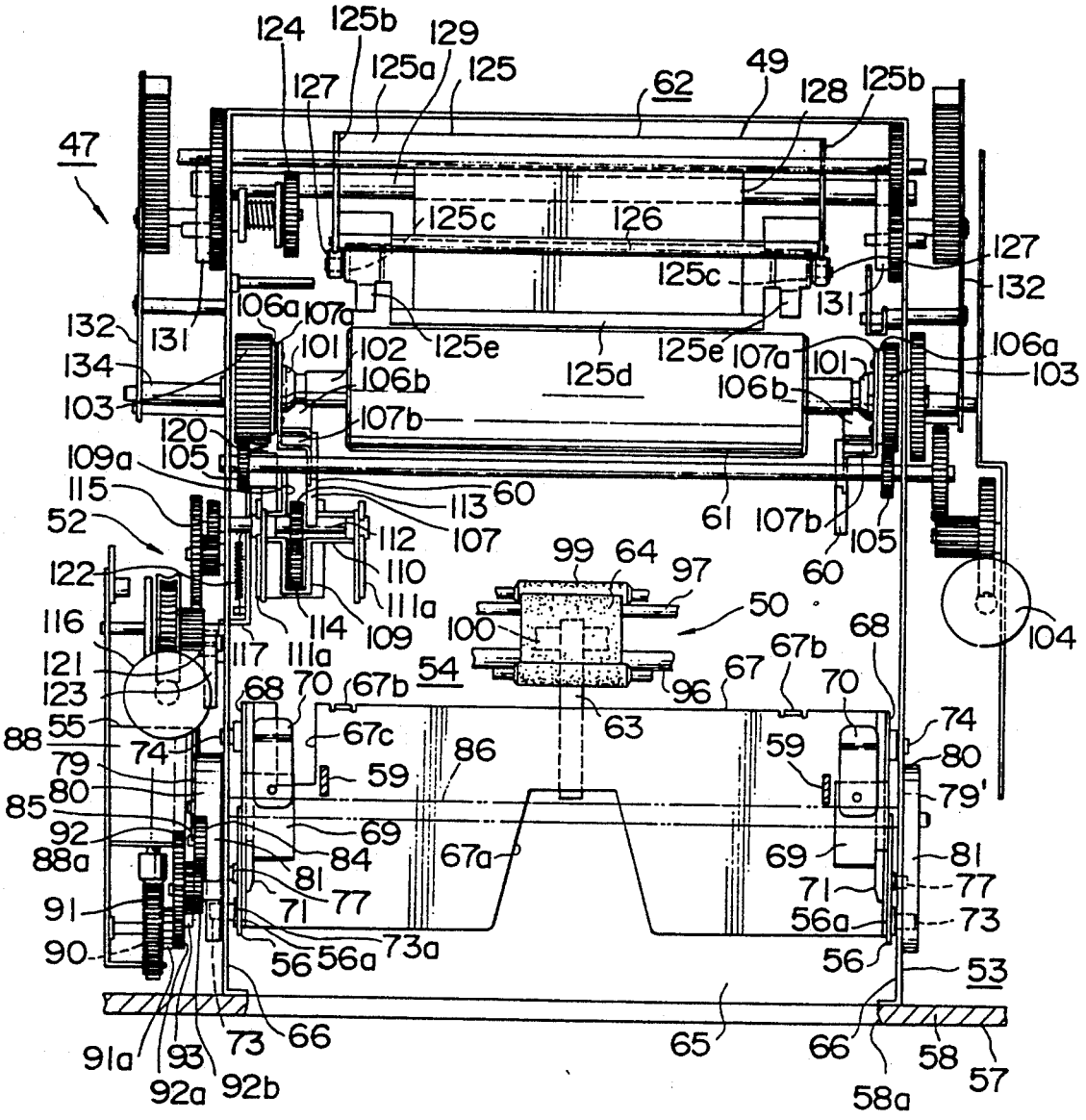

In the following description of the video printer 47, "front" refers to the lower side, "back" refers to the upper side, "right" refers to the right-hand side, "left" refers to the left-hand side, "longitudinal" refers to of the direction from the front to the back or from the back to the front, and "lateral" refers to of the direction perpendicular to the longitudinal direction as viewed in FIG. 8.

Figure 10:
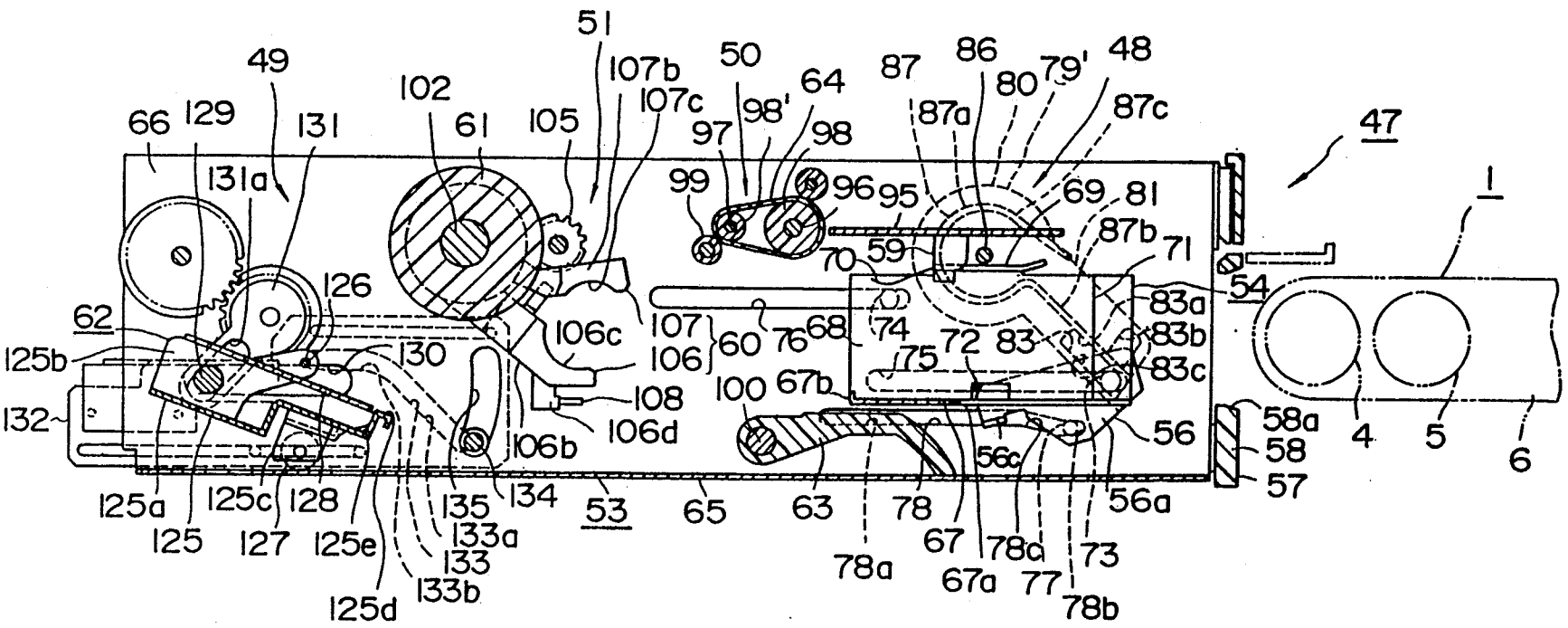
Figure 11:
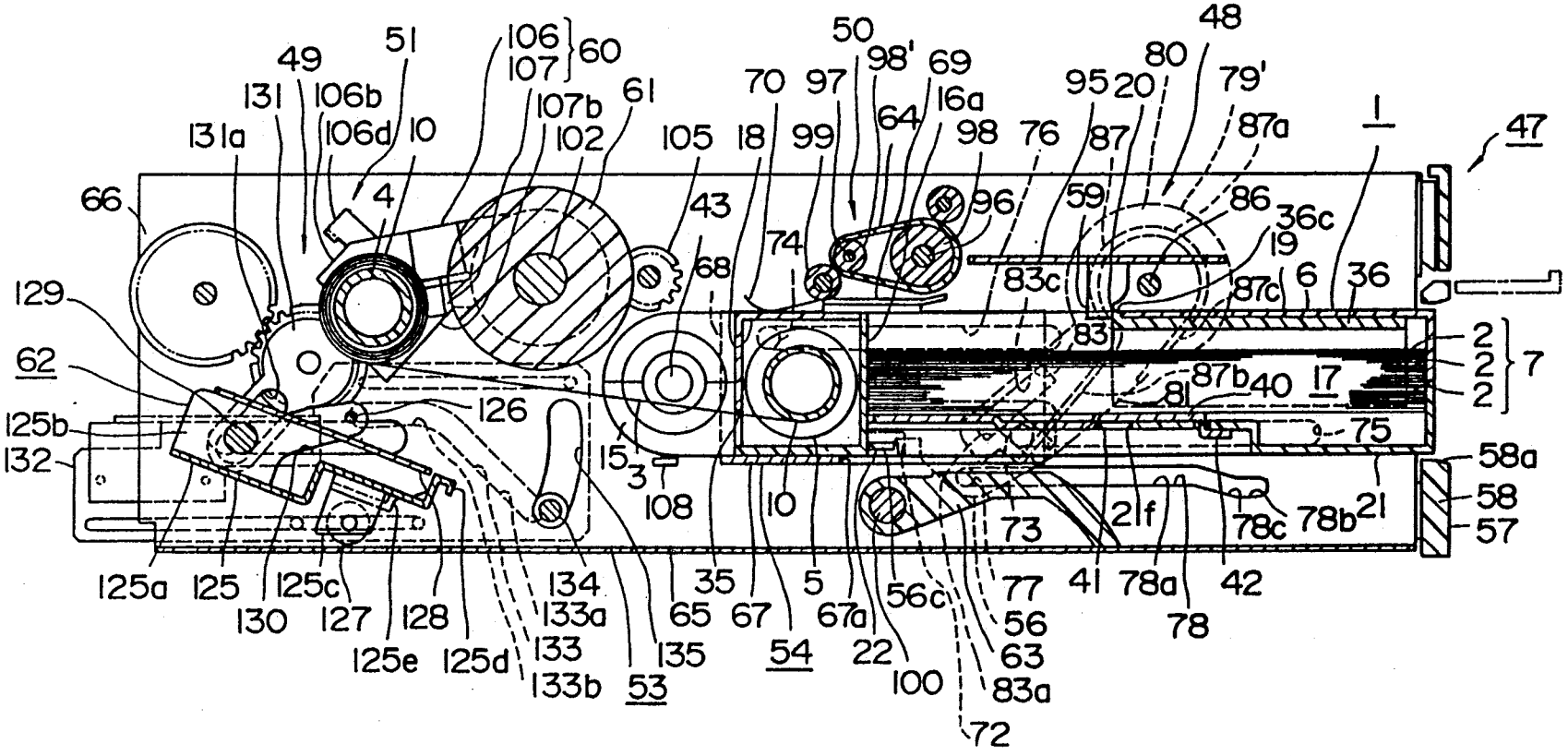
Figure 12:
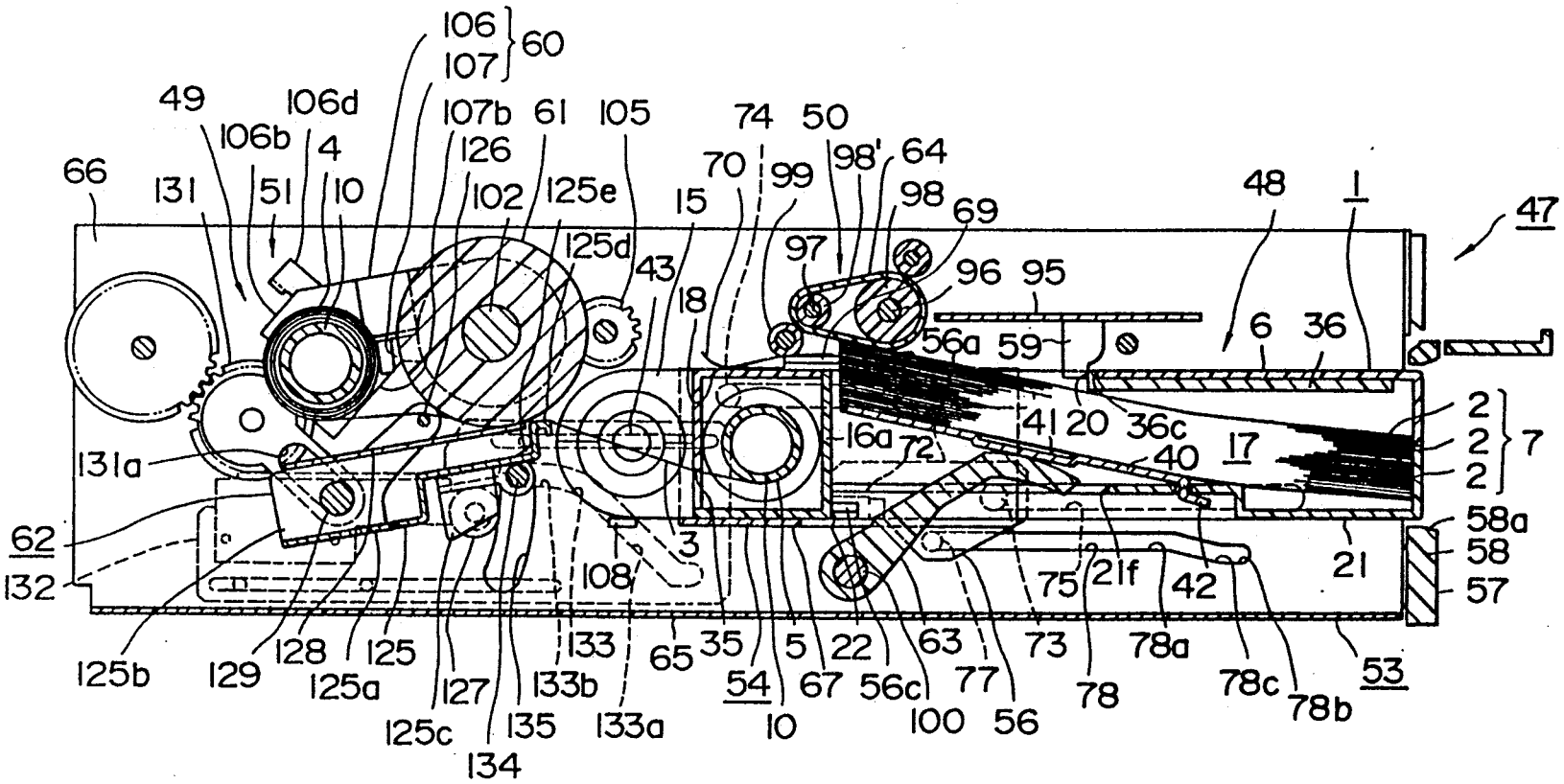
Figure 13:
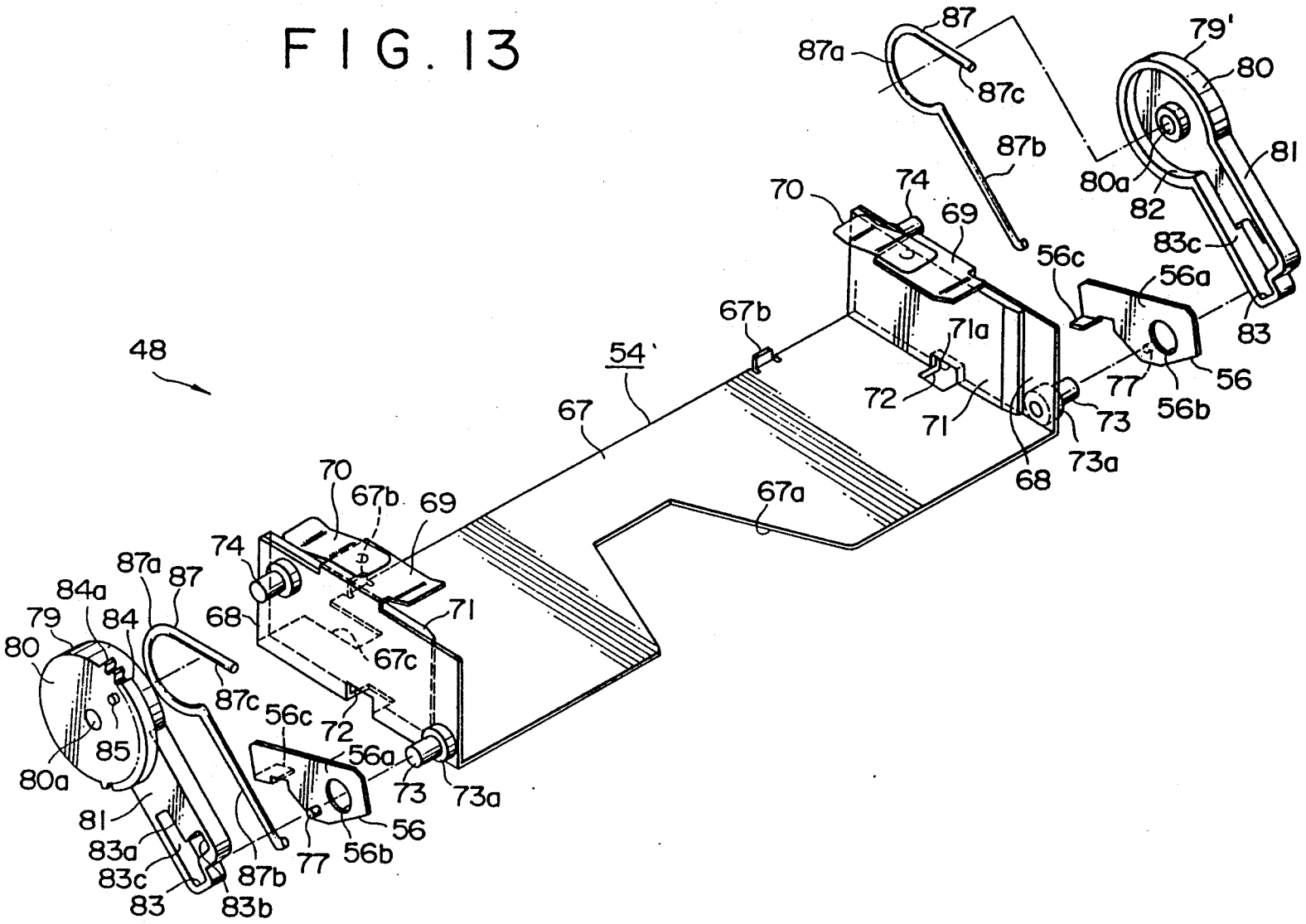
Figure 14:
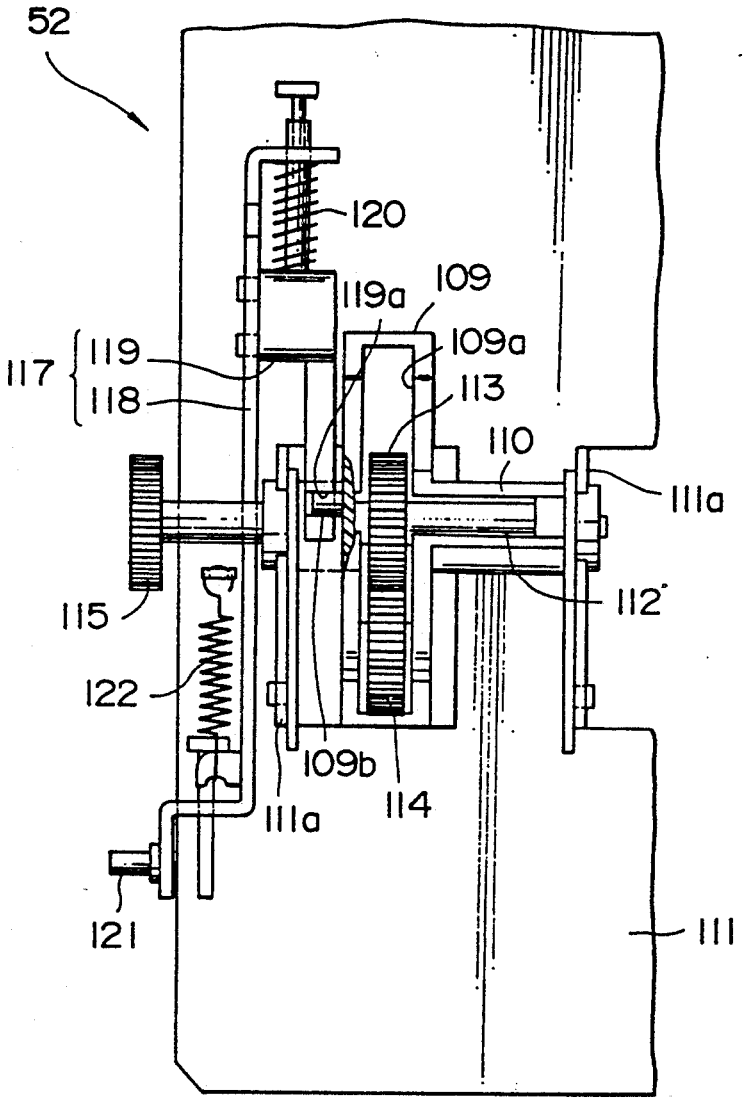

The cartridge loading mechanism 48 is removably mounted with the ribbon/printing cartridge 1. The cartridge loading mechanism 48 comprises a support frame 53, a cartridge holder 54 longitudinally movably supported on the support frame 53, a moving mechanism 55 for moving the cartridge holder 54, and locking levers 56 for locking the ribbon/printing paper cartridge 1 on the cartridge holder 54. In mounting the ribbon/printing paper cartridge 1 on and removing the same from the cartridge holder 54, the cartridge holder 54 is placed at an ejecting position behind a cartridge gate 58*a* formed in the front wall 58 of a housing 57 as shown in FIG. 10. The ribbon/printing paper cartridge 1 mounted on the cartridge holder 54 is pushed to move the cartridge holder 54 a predetermined distance backward. While the cartridge holder 54 is being moved backward, the locking levers 56 engage the locking grooves 22 of the case 6 to lock the case 6 on the cartridge holder 54, and the moving mechanism 55 is driven to move the cartridge holder 54 to a loading position, where the cartridge gate 58*a* is closed by the back wall of the case 6 as shown in FIG. 11.

While the ribbon/printing paper cartridge 1 is being moved toward the loading position, the cover 36 is opened by the cover opening members 59.

The ribbon loading mechanism 51 comprises right and left swing grippers 60 supported for swing motion, and a turning mechanism for turning the swing grippers 60. When the ribbon/printing paper cartridge 1 is set at the loading position, the swing grippers 60 hold the ribbon feed spool 4 and transfers the same to the printing unit 49 as shown in FIG. 11 to load the printing unit 49 with the ink ribbon 3.

The printing unit 49 comprises a rotary platen 61 around which is wound the printing paper 2, and a thermal print head 62. The paper feed mechanism 50 comprises a lifting arm 63, a paper feed belt 64, and a paper guide, not shown. Upon the start of printing operation, the lifting arm 63 is turned to turn the paper lifting plate 40 provided in the case 6 upward so that the leading end of the top printing paper 2 of the pile 7 is pressed against the paper feed belt 64. Then, the paper feed belt 64 is turned to pull out the top printing paper 2 from the case 6 and to deliver the printing paper 2 to the platen 61. The printing paper is guided by the paper guide, not shown, so as to travel along a paper feed path to the platen 61 and the printing paper 2 is wound around the platen 61. Then, the print head 62 is moved to press the ink ribbon 3 and the printing paper 2 against the platen 61. Then, the platen 61 is rotated, the ink ribbon 3 is advanced in synchronism with the rotation of the platen 61 and the print head 62 is driven to transfer the ink of the ink ribbon 3 to the printing paper 2 by heat.

The support frame 53 serves as a base for all the foregoing mechanisms. The support frame 53 is disposed fixedly within the housing 57 and comprises a bottom plate 65, two side plates (hereinafter referred to as "support plates") 66 standing upright from the opposite lateral edges, respectively, of the bottom plate 65.

Cartridge Loading Mechanism (FIGS. 8 to 13 and 15)

Cartridge Holder

The cartridge holder 54 comprises a laterally elongate, flat bottom plate 67 of a width slightly greater than that of the case 6, side plates 68 standing upright from the opposite lateral edges, respectively, of the bottom plate 67, comparatively small top plates 69 projecting inward from the middles of the upper edges of the side plates 68, respectively, cartridge pressers 70 formed of a spring material and fixed to the top plates 69, respectively, and inner side plates 71 formed of a synthetic resin and attached respectively to the inner surfaces of the side plates 68. The space between the bottom plate 67 and the top plates 69 is slightly greater than the thickness of the case 6, and the space between the inner side plates 71 is substantially equal to the width of the case 6.

The bottom plate 67 is provided with a comparatively large recess 67*a* having substantially the shape of a trapezoid in the middle of its front edge. Portions of the back edge of the bottom plate 67 near the opposite lateral ends are raised to form stopper lugs 67*b*. A longitudinally elongate slit 67*c* is formed in the back edge of the bottom plate 67 at a position near the left end of the same. Through holes 72 are formed at the longitudinal middles of the junctions of the bottom plate 67 and the side plates 68, respectively. Recesses 71 are formed in the lower edges of the inner side plates 71 at positions corresponding to the through holes 72, respectively.

The cartridge pressers 70 have front ends fixed to the upper surface of the top plates 69, and back ends bent substantially in the shape of a letter L and located slightly below the level of the top plates 69, respectively.

First guided pins 73 are attached to the front lower ends of the side plates 68 so as to project horizontally outward, and second guided pins 74 are attached to the back upper ends of the same so as to project horizontally outward, respectively. The guided pins 73 and 74 are substantially round pins.

Two parallel, longitudinal guide slots 75 and 76 are formed in the front half of each of the support plates 66. The first guided pins 73 are fitted in the guide slots 75 for sliding along the guide slots 75, respectively, and the second guided pins 74 are fitted in the guide slots 76 for sliding along the guide slots 76, respectively, to support the cartridge holder 54 on the support plates 66 on the level of the cartridge gate 58*a* so that the cartridge holder 54 is able to move longitudinally.

Locking Levers

Each of the locking levers 56 has a flat plate 56*a* having a length about half the length of the side plate 68, provided with a round through hole 56*b* at its front end and with a rectangular locking finger 56*c* projecting inward from the back end of its lower edges. The longitudinal size of the locking fingers 56*c* is nearly equal to the width of the locking grooves 22. Guided pins 77 are attached to the flat plates 56*a* of the locking levers 56 so as to project outward at positions near the lower edges and substantially at the middles with respect to their length, respectively.

Guide slots 78 are formed in the support plates 66 below the guide slots 75, respectively. Each guide slot 78 has a horizontal holding section 78*a*, the longest section, a horizontal front section 78*b*, and a comparatively short transient section 78*c* interconnecting the holding section 78*a* and the front section 78*b*. The transient section 78*c* is inclined upward to the back.

The locking levers 56 are disposed between the side plates 68 of the cartridge holder 54 and the support plates 66 and are put on the enlarged base ends of the first guided pins 73 so as to swing in a vertical plane, respectively. The first guided pins 77 are fitted slidably in the guide slots 78, respectively.

Accordingly, the locking levers 56 move longitudinally together with the cartridge holder 54, and the vertical position of the locking levers 56 is determined by the position of the guided pins 77 attached to the locking levers 56 in the guide slots 78.

Figure 15A:
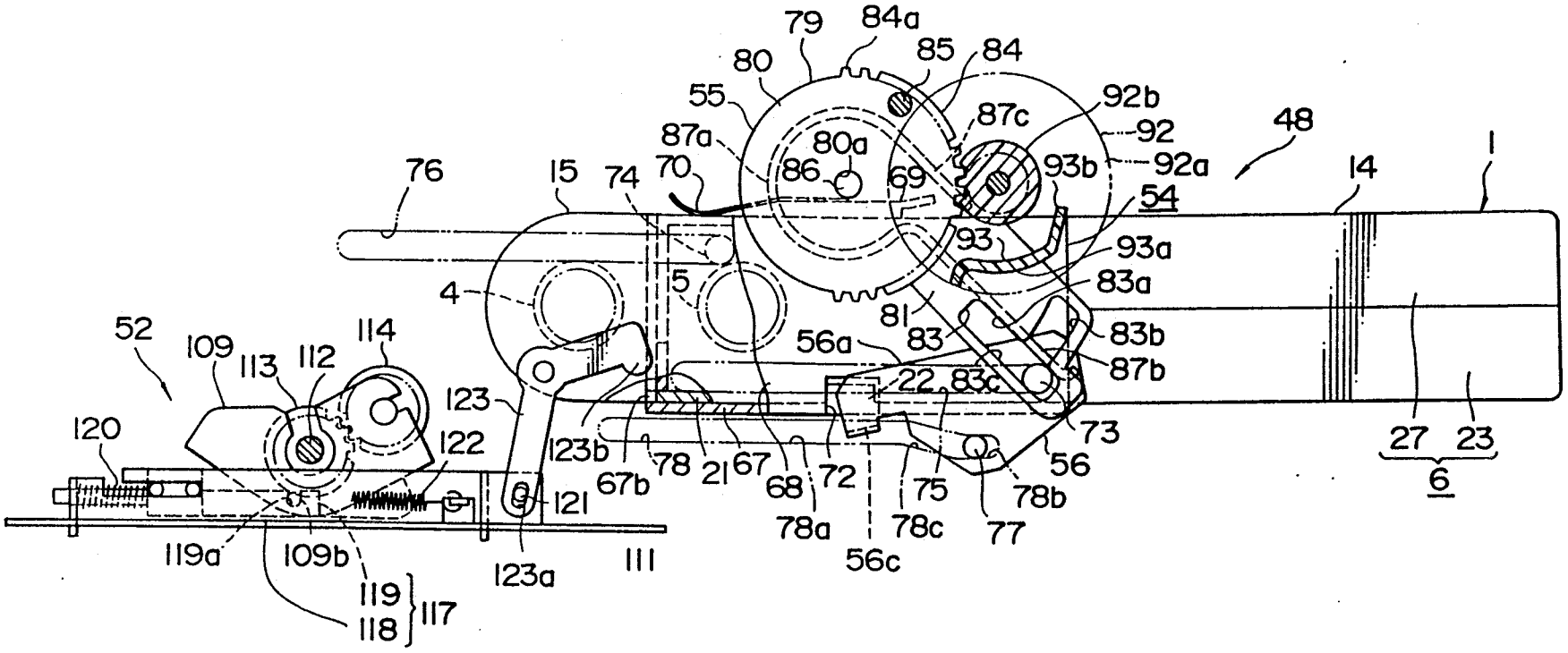
FIGS. 15(A), 15(B), 15(C) and 15(D) are enlarged plan view of an essential portion in different stages of operation.
Figure 15B:
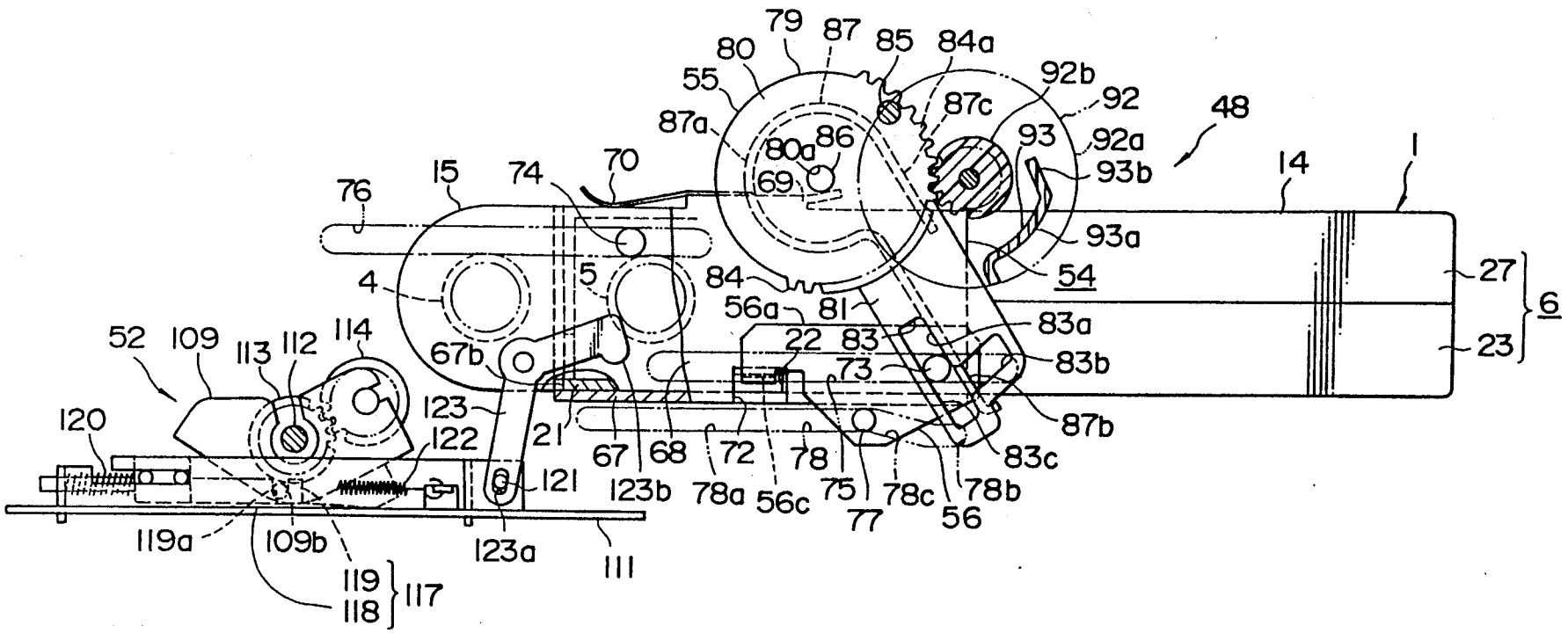

The position of the locking levers 56 relative to the cartridge holder 54 is determined so that the locking fingers 56*c* of the locking levers 56 are able to enter the through holes 72 of the cartridge holder 54. Each locking lever 56 is held at a releasing position where the locking finger 56*c* is located slightly below the bottom plate 67 of the cartridge holder 54 when the guided pin 77 is in the front section 78*b* of the guide slot 78 as shown in FIG. 15(A), and is held at a locking position where the locking finger 56*c* is located slightly above the bottom plate 67 when the guided pin 77 is in the holding section 78*a* of the guide slot 78 as shown in FIG. 15(B)

Moving Mechanism

The moving mechanism 55 for moving the cartridge holder 54 comprises two swing arms, a shaft for synchronizing the two swing arms, a motor, and a plurality of gears for transmitting the rotative driving force of the motor to one of the swing arms.

Swing Arms, Shaft and the Associated Parts

Each of the swing arms 79 and 79' has, in an integral part, a base portion 80 having the shape of a disk, and an arm portion 81 radially extending from the base portion 80 and having a width smaller than the diameter of the base portion 80. Each of the swing arms 79 and 79' has a peripheral wall extending inward to form a spring receiving space 82, a through hole 80*a* formed at the center of the base portion 80, longitudinal slot 83 formed in the front half of the arm 81, and a recess 83*b* formed in the upper surface 83*a* of the slot 83 at a position near the front end of the slot 83.

The base portion 80 of the left swing arm 79 is formed of a thickness greater than that of the arm 81 so that the left half of the base portion 80 protrude to the left from a plane including the left-hand surface of the arm 81. A gear section 84 is formed in the front half of the circumference of the left half of the base portion 80 in an angular range of 180°.

A pin 85 is attached to the left swing arm 79 at a position separated by a small angular distance in a clockwise direction from one end 84*a* (FIG. 13) of the gear section 84 so as to project to the left from the left-hand surface of the base portion 80.

The shaft 86 has portions near the opposite ends thereof journaled on the support plates 66 at a position slightly above the cartridge holder 54. Portions of the shaft 86 projecting outward from the support plates 66 are fixedly pressed in the through holes 80*a* of the swing arm s 79 and 79', respectively.

Thus, the two swing arms 79 and 79' are supported for synchronous swing motion on the support plates 66.

The extremities of the first guided pins 73 attached to the cartridge holder 54 are received slidably in the slots 83 of the swing arms 79 and 79', respectively.

The cartridge holder 54 is biased to the loading position by springs 87. Each spring 87 has a curved portion 87*a* having a shape substantially resembling the letter C, a longer portion 87*b* extending from one end of the curved portion 87*a*, and a shorter portion 87*c* extending from the other end of the curved portion 87*a*. The curved portions 87*a* of the springs 87 are placed in portions of the spring receiving spaces 82 corresponding to the base portions 80 of the swing arms 79 and 79', respectively, the longer portions 87*b* and the shorter portions 87*c* are placed in portions of the spring receiving spaces 82 corresponding to the arms 81 of the swing arms 79 and 79', respectively. The shorter portions 87*c* of the springs 87 are resiliently in contact with the upper sections of the peripheral walls 82, respectively. The extremities of the longer portions 87*b* of the springs 87 are resiliently in contact with the front sides of the guide pins 73 of the cartridge holder 54, respectively.

Accordingly, the guided pins 73 are pressed against the back surfaces 83*c* of the slots 83 by the longer portions 87*b* of the springs 87, respectively, while any force to urge the swing arms 79 and 79' counterclockwise is not applied to the swing arms 79 and 79'. When the swing arms 79 and 79' are turned clockwise, the guided pins 73 are pushed backward by the swing arms 79 and 79' to move the cartridge holder 54 backward.

The cartridge holder 54 can be moved backward also when the ribbon/printing paper cartridge 1 mounted thereon is pushed backward.

Motor, Gears and the Associated Parts

The motor 88 is mounted on a motor base 89 fixed to the outer surface of the left support plate 66. A three-thread worm 90 is fixed to the output shaft 88*a* of the motor 88.

A worm wheel 91 integrally provided with a pinion 91*a* is supported for rotation on the motor base 89 in engagement with the worm 90. A double gear 92 integrally having a gear 92*a* and a pinion 92*b* is supported for rotation on the support plate 66 so that the gear 92*a* is in engagement with the pinion 91*a*, and the pinion 92*b* is in engagement with the gear section 84 of the swing arm 79.

The shaft of the double gear 92 is located on the front side of the axis of rotation of the swing arm 79. The gear 92*a* of the double gear 92 is disposed on the left side of the swing arm 79 so as to overlap the swing arm 79. A cam 93 is formed on the right surface of the gear 92*a* near the periphery of the same. The cam 93 has a holding section 93*a* extending in parallel to the circumference of the gear 92*a*, and a comparatively short, substantially straight pressing section 93*b* extending in a counterclockwise direction, as viewed from the left side of the gear 92*a*, from the holding section 93*a* so as to approach the center of the double gear 92 with the distance from the junction of the holding section 93*a* and the pressing section 93*b*. A circle along which the substantially middle position of the pressing section 93*b* turns is externally in contact with a circle along which the pin 85 of the swing arm 79 turns.

Figure 9:
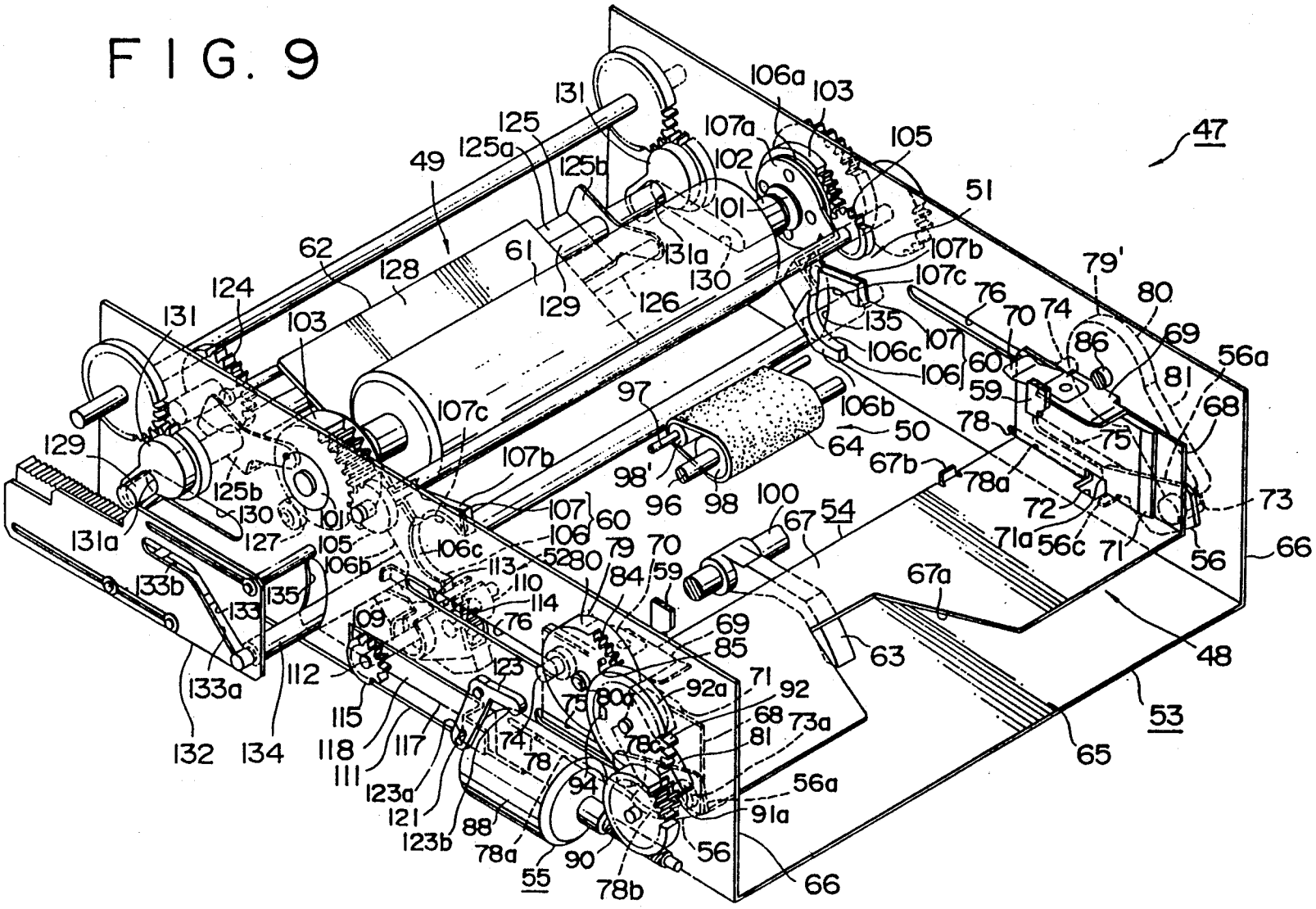

A reflective mark 94 is formed on the left surface of the gear 92*a* of the double gear 92 (FIG. 9).

The motor 88 is actuated for rotation to drive the worm gear 91 for clockwise rotation for moving the cartridge holder 54 backward (hereinafter, the rotation of the motor 88 for such a purpose will be referred to as "normal rotation"), and is actuated for rotation to drive the same for counterclockwise rotation for moving the cartridge holder 54 forward (hereinafter, the rotation of the motor 88 for such a purpose will be referred to as "reverse rotation").

When the motor 88 is driven for normal rotation, the double gear 92 is driven in a counterclockwise rotation, the swing arms 79 and 79' are turned clockwise to push the guided pins 73 of the cartridge holder 54 backward, so that the cartridge holder 54 is moved backward. When the motor 88 is driven for reverse rotation, the worm wheel 91 is driven in a counterclockwise rotation, the double gear 92 is driven in a clockwise rotation, the swing arms 79 and 79' are turned in a counterclockwise direction to push the guided pins 73 forward, so that the cartridge holder 54 is moved forward.

Loading Ribbon/Printing Paper Cartridge

In an initial state, the swing arms 79 and 79' are at the home position, where the arms 81 extend diagonally to the front from the base portions 80 as shown in FIG. 15(A), the cartridge holder 54 is at the ejecting position, the locking levers 56 are held at the releasing position with their guided pins 77 at the front ends 78*b* of the guide slots 78.

In loading the ribbon/printing paper cartridge 1, the ribbon/printing paper cartridge 1 is inserted in the cartridge holder 54 and is pushed to move the cartridge holder 54 slightly backward.

The ribbon/printing paper cartridge 1 is inserted in the cartridge holder 54 until the front side of the main body 14 strikes against the stopper lugs 67*b*, and then the ribbon/printing paper cartridge 1 is pushed backward so that the cartridge holder 54 is moved a predetermined distance backward from the ejecting position to a position shown in FIG. 15(B). During the backward movement of the cartridge holder 54, the guided pins 77 of the locking levers 56 are moved along the transient sections 78*c* of the guide slots 78 to the front ends of the holding sections 78*a*, respectively, and, consequently, the locking fingers 56*c* of the locking levers 56 drop into the locking grooves 22 of the case 6 to restrain the case 6 from longitudinal movement relative to the cartridge holder 54.

The ribbon/printing paper cartridge 1 inserted in the cartridge holder 54 is located in place with respect to the lateral direction by the inner side plates 71 of the cartridge holder 54, and the ribbon/printing paper cartridge 1 is pressed elastically against the bottom plate 67 of the cartridge holder 54 by the cartridge pressers 70. The slot 21*f* formed in the bottom wall 21 of the case 6 faces the trapezoidal recess 67*a* of the bottom plate 67 of the cartridge holder 54, and the slot 21*d* of the case 6 coincides with the recess 67*c* formed in the bottom plate 67 of the cartridge holder 54.

While the cartridge holder 54 is being pushed by the ribbon/printing paper cartridge 1 and is being moved backward, the guided pins 73 push the back surfaces 83*c* of the slots 83 of the swing arms 79 and 79', respectively, to turn the swing arms 79 and 79' clockwise and, consequently, the double gear 92 is turned counterclockwise, the worm wheel 91 is turned clockwise and hence the motor 88 is forced to turn in a normal rotation.

Substantially simultaneously with the arrival of the locking levers 56 at the locking position, the reflective mark 94 attached to the double gear 92 arrives at a position opposite a reflection photosensor, not shown. Then, the photosensor provides a signal to actuate the motor 88 for normal rotation.

Then, the swing arms 79 and 79' are driven for clockwise turning by the motor 88 to move the cartridge holder 54 backward by the moving mechanism 55.

Figure 15C:
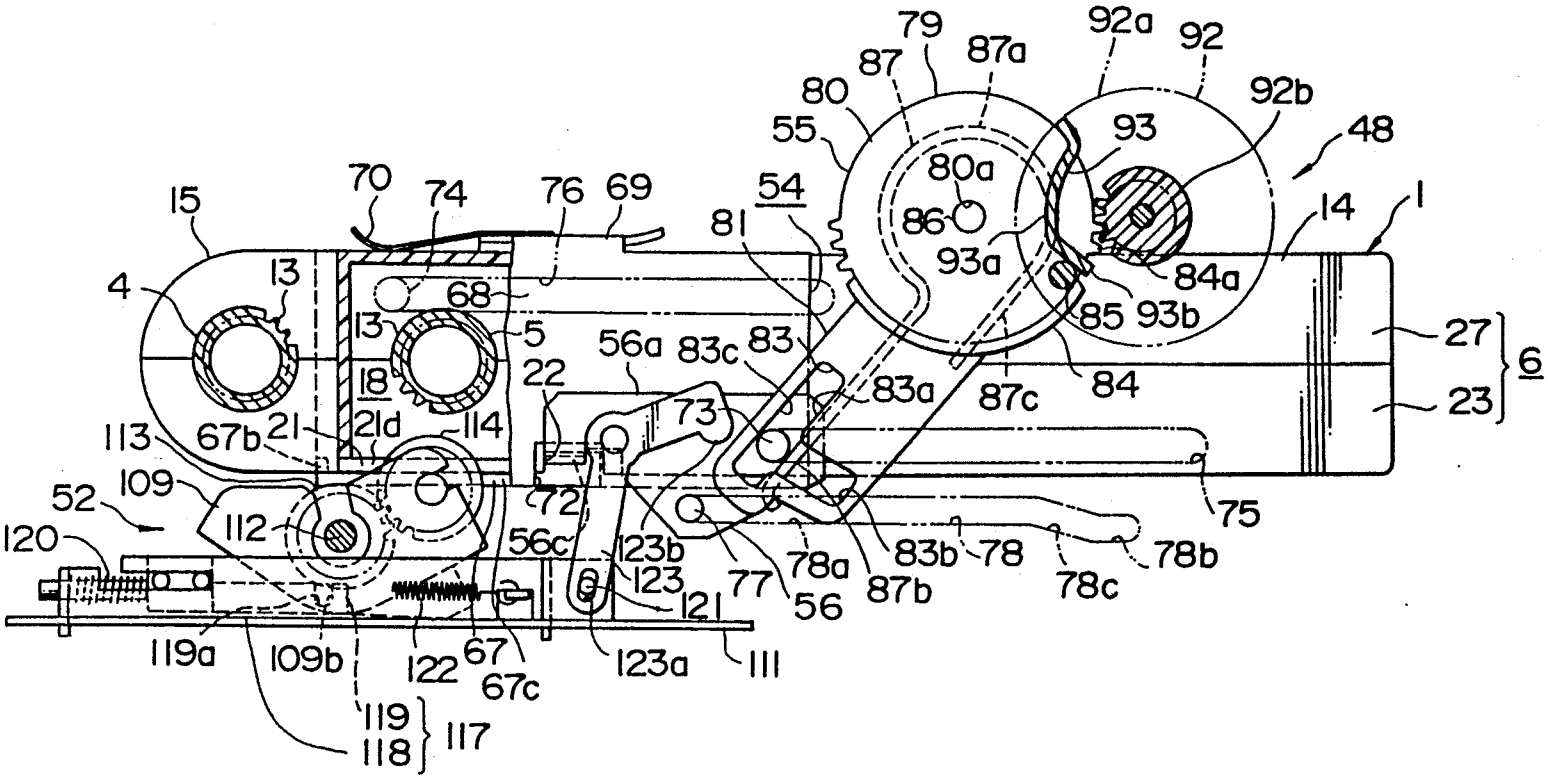

When the swing arms 79 and 79' are turned through about 90° from the home position, the cartridge holder 54 arrives at the loading position, where the guided pins 73 and 74 of the cartridge holder 54 arrive at the back ends of the corresponding guide slots 75 and 76, respectively, as shown in FIG. 15(C) to restrain the cartridge holder 54 from further backward movement.

In this state, the pinion 92*b* of the double gear 92 engages the teeth of the gear section 84 of the swing arm 79 near the end 84*a* of the gear section 84, and the pressing section of the cam 93 of the double gear 92 is in contact with the pin 85 from above.

The normal rotation of the motor 88 is stopped after the double gear 92 has been turned to some extent in a counterclockwise direction from the same state to turn the swing arm 79 further clockwise by pushing the pin 85 of the swing arm 79 by the pressing section 93*b* of the cam 93. The clockwise turning of the swing arm 79 is stopped upon the engagement of the pin 85 with the holding section 93*a* of the cam 93.

Figure 15D:
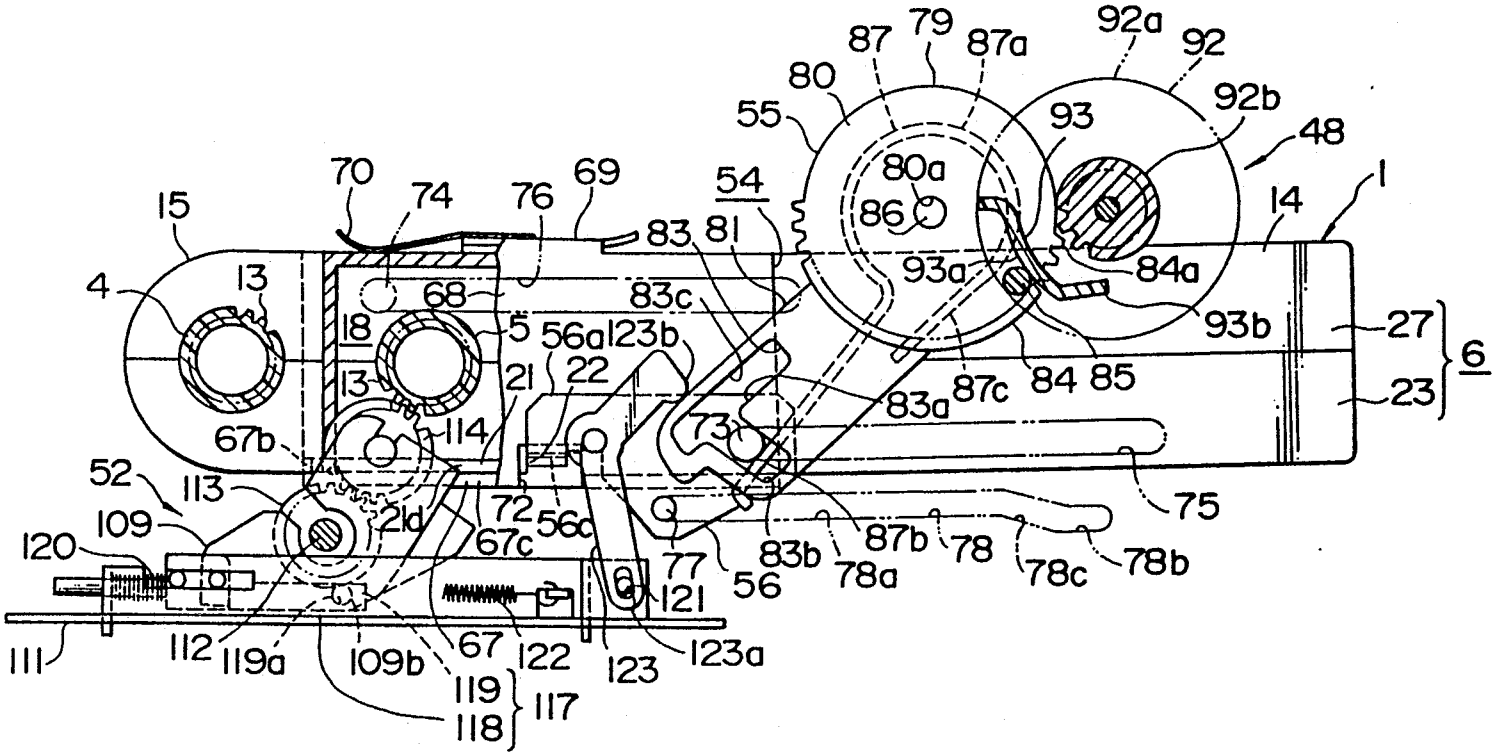

Thus, the swing arms 79 and 79' are turned clockwise through a small angle after the cartridge holder 54 has arrived at the loading position. Therefore, the back surfaces 83*c* of the slots 83 of the swing arms 79 and 79' are separated from the first guided pins 73 and the first guided pins 73 are received in the recesses 83*b* of the slots 83 as shown in FIG. 15(D), respectively, when the clockwise rotation of the swing arms 79 and 79' is stopped. Consequently, the longer portions 87*b* of the springs 87 press the first guided pins 73 resiliently against the back ends of the guide slots 75, respectively.

Although the swing arms 79 and 79' are urged counterclockwise in this state, the swing arms 79 and 79' are restrained from counterclockwise turning by the holding section 93*a* of the cam 93 engaging the pin 85.

Thus, the cartridge holder 54 is held by pressure at the loading position.

The ribbon/printing paper cartridge 1 is loaded in the video printer 47 in the foregoing manner.

When a command requesting the ejection of the ribbon/printing paper cartridge 1 from the video printer 47 is given, the motor 88 is driven for reverse rotation, the double gear 92 is rotated clockwise and the pin 85 of the swing arm 79 is released from the holding section 93*a* of the cam 93 of the double gear 92. Then, the swing arms 79 and 79' are turned counterclockwise by the resilient force of the springs 87, and then the pinion 92*b* of the double gear 92 engages the teeth of the gear section 84 near the end 84*a* of the gear section 84. Consequently, the swing arms 79 and 79' are turned further counterclockwise to move the cartridge holder 54 to the ejecting position. The locking levers 56 are returned to the releasing position immediately before the arrival of the cartridge holder 54 at the ejecting position.

Cover Opening and Closing Operation (FIGS. 8 to 12)

A paper delivery guide plate 95 (FIGS. 10 to 12) is disposed in a horizontal position in the upper front half section of the space within the support frame 53. The comparatively small cover opening members 59 having the shape of a plate project downward from the paper delivery guide plate 95 at positions near the opposite side edges of the paper delivery guide plate 95.

The cover opening members 59 extend downward beyond the top plates 69 of the cartridge holder 54 and correspond to the longitudinal grooves 19*c* formed in the upper surface of the case 6 of the ribbon/printing paper cartridge 1, respectively.

When the ribbon/printing paper cartridge 1 is inserted in the cartridge holder 54, the lower ends of the cover opening members 59 are received in the longitudinal grooves 19*c* of the case 6. Substantially at the moment when the case 6 starts pushing the cartridge holder 54 backward, the lower ends of the cover opening members 59 engage the flange 36*c* of the cover 36 and, consequently, the cover 36 is moved forward relative to the case 6 to the open position as the case 6 is moved backward. Substantially simultaneously with the arrival of the ribbon/printing paper cartridge 1 at the loading position, the cover 16 reaches the open position to open the paper feed opening 20.

When the ribbon/printing paper cartridge 1 is moved forward from the loading position, the cover 36 is released from the pressure of the cover opening members 59, and then the cover 36 is moved toward the closing position by the extension springs 38. The cover 36 closes the paper feed opening 20 completely substantially simultaneously with the arrival of the cartridge holder 54 at the ejecting position.

Thus, the paper feed opening 20 is closed before the ribbon/printing paper cartridge 1 is removed from the cartridge holder 54. Accordingly, the printing papers remaining in the ribbon/printing paper cartridge 1 are not touched.

Paper Feed Mechanism (FIGS. 8 to 12)

A front shaft 96 and a back shaft 97 are journaled on the support plates 66 so as to extend across the space between the support plates 66 at an interval therebetween in the upper central region of the interior of the support frames 53 with respect to the longitudinal direction. The front shaft 96 is driven for clockwise rotation, as viewed from the left side, by a driving mechanism, not shown.

Rollers 98 and 98' are fixedly put on the middle portions of the shafts 96 and 97, respectively, and a wide endless paper feed belt 64 is extended between the rollers 98 and 98'.

The front shaft 96 is disposed so that the roller 98 fixed thereto is disposed above and near the middle portion with respect to the lateral direction near the front side of the paper feed opening 20 of the ribbon/-printing paper cartridge 1.

A driven roller 99 is pressed upward against the back roller 98' through the paper feed belt 64.

The shaft 96 is rotated so that the lower run of the paper feed belt 64 runs backward, and then the driven roller 99 rotates counterclockwise, as viewed from the left side.

The lifting arm 63 having a front portion declined to the front is disposed longitudinally.

A shaft 100 is supported for rotation on bearing members, not shown, so as to extend laterally in the lower middle region of the interior of the support frame 53. The lifting arm 63 is fixed at its back end to the shaft 100.

A rotative force tending to bias the shaft 100 counterclockwise, as viewed from the left side, is applied to the shaft 100 by elastic means, not shown. While no paper feed command is given, the lifting arm 63 is held in a substantially horizontal position against the rotative force. In response to a paper feed command, the lifting arm 63 is released from the horizontal position. When held in the horizontal position, the lifting arm 63 is on a level slightly below a plane including the passage of the cartridge holder 54. When the cartridge holder 54 is located at the loading position, the recess 67*a* of the bottom plate 67 of the cartridge holder 54 is located above the lifting arm 63.

When a paper feed command is given after the ribbon/printing paper cartridge 1 has been located at the loading position, the paper feed belt 64 starts turning, the lifting arm 63 is turned counterclockwise so that the front half of the lifting arm 63 projects through the slot 21*f* formed in the bottom wall 21 of the case 6 into the printing paper chamber 17 to push the paper lifting plate 40 at the protrusion 41.

Since the paper lifting plate 40 is thus turned upward, the pile 7 of the printing papers 2 is lifted up to press the leading end of the top printing paper 2 against the lower run of the paper feed belt 64. Then, the top printing paper 2 is drawn out by the paper feed belt 64 and the driven roller 99 from the printing paper chamber 17, the printing paper 2 is transported along a paper guide, not shown, and the printing paper 2 is wound around the platen 61.

Ink Ribbon Loading Mechanism (FIGS. 8 to 12)

Bearing members 101 having a substantially cylindrical shape are attached to the inner surfaces of the support plates 66 at positions near the upper edges of the support plates 66 and a little behind the middles of the support plates 66 with respect to the longitudinal direction, respectively. A shaft 102 fixedly provided with the platen 61 is supported for rotation at its opposite ends in the bearing members 101.

Arm turning gears 103, namely, a comparatively thick spur gears, are mounted rotatably on the bearing members 101, respectively. Two driving gears 105 which are driven synchronously by a motor 104 are in engagement with the arm turning gears 103, respectively.

Each swing gripper 60 comprises two swing members 106 and 107, and an extension spring, not shown, is extended between the swing members 106 and 107. The swing member 106 has a base 106*a* of a shape substantially resembling a disk, as viewed laterally, and an arm 106*b* of a shape substantially resembling a crank, as viewed from above, extending from the circumference of the base portion 106*a*. The swing member 107 has a base 107*a* similar to the base 106*a*, and an arm 107*b* similar to the arm 106*b*. The front portions of the arms 106*b* and 107*b* extend opposite to each other, and have concave edges 106*c* and 107*c* each of an arc of a circle.

When the swing grippers 60 are at a waiting position as shown in FIG. 10, the bases 106*a* of the lower swing members 106 are mounted rotatably on bosses, not shown, formed on the inner surfaces of the arm turning gears 103, respectively, and the bases 107*a* of the upper swing members 107 are fixed coaxially with the bosses 106*a* of the lower swing members 106 to the inner ends of the bosses. Tension springs are extended between the lower swing members 106 and the corresponding upper swing members 107 to pull resiliently the lower swing members 106 and the corresponding upper swing members 107 toward each other so that the curved edges 106*c* of the lower swing members 106 and the curved edges 107*c* of the corresponding upper swing members 107 form circles, respectively.

In the initial state, the swing grippers 60 are held at the waiting position, in which the arms 106*b* of the lower swing members 106 are held so that the curved edges 106*c* are inclined upward to the front, and the arms 107*b* of the upper swing members 107 are held so that the curved edges 107*c* are inclined downward to the front. The swing members 106 are restrained from further counterclockwise turning from the said position by stoppers 108 fixed to the support plates 66 and engaging lugs 106*d* projecting from the arms 106*b*, respectively. The upper swing members 107 are held in the same position by determining angular position of the arm turning gears 103.

When the ribbon/printing paper cartridge 1 is placed at the loading position with the video printer 47 in the initial state, portions of the spindle 10 of the ribbon feed spool 4 extending outside from the outer flanges 11 are located between the curved edges 106*c* of the lower swing members 106 and the curved edges 107*c* of the corresponding upper swing members 107, respectively.

Upon the detection of the arrival of the ribbon/printing paper cartridge 1 at the loading position, the motor 104 is actuated to drive the arm turning gears 103 in a clockwise direction, as viewed from the left, by the driving gears 105.

Then, only the swing members 107 are turned clockwise, and the arms 107*b* are brought into contact with the corresponding arms 106*b* of the swing members 106, respectively. Thus, the spindle 10 of the ribbon feed spool 4 is supported rotatably at the portions extending outward from the outer flanges 11 between the curved edges 106*c* of the arms 106*b* and the corresponding curved edges 107*c* of the arms 107*b*, respectively. Then, as the arm turning gears 103 are turned further in a clockwise direction, the swing arms 106 and the corresponding swing arms 107 are turned together. Upon the arrival of the swing grippers 60 at the loading completion position, as shown in FIG. 11, to locate the ribbon feed spool 4 at the operating position behind the platen 61, the motor 104 is stopped.

In taking out the ribbon feed spool 4 from the case 6 by the swing grippers 60, the opposite ends of the bore 10*a* of the spindle 10 ride over the taper portions 44*a* of the holding bosses 44 of the spool holders 43 pushing the spool holders 43 into the corresponding arms 15 of the case 6.

A locking lever, not shown, supported on the swing member 106 of the left swing gripper 60 engages the gear 13 of the ribbon feed spool 4 to restrain the ribbon feed spool 4 from rotation while the same is being transported to the loading position and, consequently, the ink ribbon 3 is unwound from the ribbon winding spool 5 while the ribbon feed spool 4 is being transported to the loading position.

The ink ribbon 3 unwound from the ribbon winding spool 5 extends under the platen 61 between the ribbon feed spool 4 and the ribbon winding spool 5.

In this state, the video printer 47 is set in its home position.

When a command requesting unloading the ink ribbon 3 is given, the motor 104 is actuated to return the ribbon feed spool 4 into the case 6 by turning the arm turning gear 103 in a counterclockwise direction together with the swing grippers 60 by the driving gears 105. In returning the ribbon feed spool 4 into the case 6, the swing members 106 are stopped by the stoppers 108 substantially at the same time when the holding bosses of the spool holders 43 plunge into the bore 10*a* of the spindle 10 of the ribbon feed spool 4, and then the arm turning gears 103 are stopped.

Since the swing members 106 and the corresponding swing arms 107 of the swing grippers 60 are separated from each other, the ribbon feed spool 4 is released from the swing grippers 60.

Ink Ribbon Feed Mechanism (FIGS. 8, 9, 14 and 15)

The ink ribbon feed mechanism comprises a rocking lever holding a winding gear for rotating the ribbon winding spool 5, a slide plate assembly for turning the rocking lever, an intermediate lever to be pushed by the swing arm 79 for a predetermined timed operation to advance the slide plate assembly, and a motor for rotating the winding gear.

The rocking lever 109 has a substantially V-shaped recess 109*a* opening upward, and a substantially cylindrical boss 110 laterally protruding in opposite directions and mounted on a shaft 112 journaled on support plates 65 of the support frame 53. An intermediate gear 113 is fixed to the shaft 112 and disposed in the recess 109*a* of the rocking plate 109. A winding gear 114 is supported rotatably at the front end of the recess 109*a* of the rocking plate 109 so as to engage the intermediate gear 113 and to protrude partly from the front and upper ends of the rocking plate 109. A driven gear 115 fixed to the left end of the shaft 112 is driven by a motor 116. The motor 116 drives the winding gear 114 for rotation through the driven gear 115, the shaft 112 and the intermediate gear 113. The winding gear 114 is always driven in a clockwise rotation, as viewed from the left side.

The slide plate assembly 117 comprises a main plate 118 supported for longitudinal sliding movement in the left-hand portion of the upper surface of the base plate 111, an auxiliary plate 119 supported on the main plate 118 for sliding movement in a fixed range, a limiter spring 120 compressed between the respective back ends of the main plate 118 and the auxiliary plate 119, and a connecting pin 121 projecting to the left from the front end of the main plate 118. A projection 109*b* projecting to the left from a position slightly behind the center of the turning motion of the rocking lever 109 and on the lower end of the rocking plate 119 is in engagement with a recess 119*a* formed in the front end of the upper surface of the auxiliary plate 119.

An extension spring 122 is extended between the main plate 118 and the base plate 111 to bias the main plate 118 backward. The slide plate assembly 117 is held at a position corresponding to the rearmost of the range of movement (hereinafter referred to as "retracted position") while the main plate 118 is not pushed forward. With the slide plate assembly at the retracted position, the rocking lever 109 is held at a waiting position, where the winding gear 114 is held at a position slightly below the path of movement of the ribbon winding spool 5 of the ribbon/printing paper cartridge 1 held on the cartridge holder 54.

As the ribbon/printing paper cartridge 1 approaches the loading position, part of the winding gear 114 enters the spool chamber 18 through the slot 21*d* of the case 6 and is disposed under and opposite the gear 13 of the ribbon winding spool 5 as shown in FIG. 15(C).

The intermediate lever 123 of a shape substantially resembling the letter L(FIG. 15(C) is supported pivotally at its middle on the left support plate 66 and is provided with a slot 123*a* in its lower end. The connecting pin 121 projecting to the left from the front end of the main plate 118 is received slidably in the slot 123*a* of the intermediate lever 123.

While the swing arm 79 turns to press the cartridge holder 54 to the loading position after the cartridge holder 54 has arrived at the loading position, the extremity of the arm 81 of the swing arm 79 pushes the upper end 123*b* of the intermediate lever 123 as shown in FIG. 15(D) to advance the slide plate assembly 117 by turning the intermediate lever 123 counterclockwise, as viewed from the left side. Consequently, the projection 109*b* of the rocking lever 109 is pushed to the front to turn the rocking lever 109 counterclockwise, so that the winding gear 114 and the gear 13 of the ribbon winding spool 5 are engaged.

The winding gear 114 is pressed against the gear 13 of the ribbon winding spool 5 by the resilient force of the limiter spring 120.

In this state, the motor 116 is actuated to wind the ink ribbon 3 by rotating the ribbon winding spool 5 counterclockwise, as viewed from the left side.

The motor 116 is actuated in response to a print start command or to an ejection command requesting the ejection of the ribbon/printing paper cartridge 1 to pull out the ink ribbon 3 from the ribbon feed spool 4 for printing or to take up a portion of the ink ribbon 3 extending between the ribbon feed spool 4 and the ribbon winding spool 5 in returning the ribbon feed spool 5 into the case 6.

As the cartridge holder 54 is moved toward the ejecting position, the intermediate lever 123 is released from the swing arm 79, and then the slide plate assembly 117 is returned to the retracted position by the pulling force of the extension spring 122, so that the rocking lever 109 is returned to the waiting position.

As the ribbon feed spool 4 is transported to the loading position, a back tension gear 124 supported on the support plate 66 engages the gear 13 of the ribbon feed spool 4 and applies a moderate torque to the ribbon feed spool 4 to apply an appropriate tension to the ink ribbon 3 being unwound from the ribbon feed spool 4.

Printing unit and Printing Operation (FIGS. 8 to 12)

Printing Unit

Paper gripping means, not shown, are provided on the circumference of the platen 61. The leading edge of the printing paper 2 drawn out from the ribbon/printing paper cartridge 1 by the paper feed mechanism is gripped by the paper gripping means, and then the platen 61 is turned to wind the printing paper 2 around the platen 61.

A print head 62 moves in the rear end of the support frame 53.

The print head 62 is mounted on a carriage 125. The carriage 125 is formed by bending a metal plate and comprises a laterally elongate main portion 125*a*, side portions 125*b* standing upright respectively from the opposite lateral ends of the main portion 125*a*, roller supporting portions 125*c* extending downward respectively from the opposite lateral ends of the front half of the main portion 125*a*, a guide portion 125*d* projecting upward from the front edge of the main portion 125*a*, and projections 125*e* projecting upward respectively from positions on the front half of the main portion 125*a* near the opposite lateral ends. A ribbon guide 126 is extended between the front ends of the side portions 125*b*. Rollers 127 are supported for rotation on the outer surfaces of the roller supporting portions 125*c*, respectively.

A printed wiring board 128 is attached to the carriage 125 in parallel to the main portion 125*a*, and a printing element, not shown, is mounted on the front end of the printed wiring board 128.

A movable shaft 129 is extended laterally with its opposite ends slidably received in longitudinal guide slots 130 formed in the support plates 66, respectively. The side portions 125*b* of the carriage 125 are supported pivotally on the movable shaft 129.

Swing plates 131 are supported pivotally for swinging motion on the support plates 66 and are provided at their extremities with slots 131*a*. The opposite ends of the movable shaft 129 are received slidably in the slots 131*a* of the swing plates 131, respectively.

The rollers 127 are capable of rolling on the bottom plate 65 of the support frame 53.

Thus, the print head 62 is supported for longitudinal movement by the rollers 127 and the movable shaft 129 on the support frame 53, and for swing motion on the movable shaft 129. When the swing plates 131 are turned, the print head 62 is moved longitudinally between a retracted position, where the print head 62 is located under and behind the platen 61 with a space allowing the transportation of the ribbon winding spool 4 therebetween as shown in FIG. 10, and an advanced position, where the print head 62 is located directly under the platen 61.

Sliders 132 are supported for longitudinal movement in; a fixed range on the outer surface of the support plates 66. The sliders 132 are provided in their front portions with control slots 133, respectively. The front half sections 133*a* of the control slots 133 are inclined upward to the back, and the back half sections 133*b* of the same are extended horizontally.

A head lifting shaft 134 is supported for up-and-down movement at its portions near the opposite ends in guide slots 135 formed in the support plates 66 in the shape of a circular arc. The opposite ends of the head lifting shaft 134 are received slidably in the control slots 133, respectively.

The guide slots 135 have the shape of an arc of a circle having its center on the axis of the movable shaft 129 in a state where the print head 62 is located at the advanced position.

Accordingly, the head lifting shaft 134 is moved vertically when the sliders 132 are moved longitudinally.

In the initial state, the print head 62 is held at the retracted position, i.e., the lowermost position in the range of movement, the sliders 132 are held at the rearmost position in the range of movement, and the opposite ends of the head lifting shaft 134 are located at the front ends of the control slots 133 of the sliders 132.

As the print head 62 approaches the advanced position, the projections 125*e* come into contact with the upper back portions of the head lifting shaft 134, and then the sliders 132 start moving forward. Then, the opposite ends of the head lifting shaft 134 move upward along the front half sections 133*a* of the control slots 133 of the sliders 132 and, consequently, the head lifting shaft 134 is shifted upward along the guide slots 135 to push up the projections 125*e* of the print head 62. Consequently, the print head 62 is turned counterclockwise, as viewed from the left side, to locate the printing element, not shown, at the printing position so that the printing element is pressed against the lower circumference of the platen 61. In this state, the head lifting shaft 134 is held at a height corresponding to that of the back half sections 133*b* of the control slots 133 of the sliders 132.

Printing Operation

When a printing start command is given with the video printer 47 in the home position with the ink ribbon 3 loaded thereon, the printing paper 2 is fed from the ribbon/printing paper cartridge 1 and wound around the platen 61, and then the print head 62 is moved to the printing position and the printing element of the print head 62 is pressed through the printing paper 2 and the ink ribbon 3 against the platen 61. In this state, the ink ribbon 3 extending between the ribbon feed spool 4 and the ribbon winding spool 5 is extended along a path including the ribbon guide 126 and guide portion 125*d* of the print head 62.

In this state, the ink ribbon 3 is adjusted to locate the ink layers 9 of the ink ribbon 3 correctly relative to the printing paper 2, the platen 61 is rotated, the ink ribbon 3 is fed synchronously with the plate 61 to transfer the inks of the ink layers 9 successively in a printing pattern to the printing paper 2 to form a color print of a plurality of colors.

Ribbon/Printing Paper Cartridge in a Second Embodiment (FIGS. 16 to 21)

FIGS. 16 to 21 show a ribbon/printing paper cartridge 136 in a second embodiment according to the present invention.

The significant difference between the ribbon/printing paper cartridges 1 and 136 is that the ribbon/printing paper cartridge 136 is provided with a swing cover (hereinafter referred to as the "first cover") for covering the spools, a swing cover (hereinafter, referred to as the "second cover") for covering a paper feed opening, and locking members for locking the first and second covers.

In the following description, parts having the same construction or functions as those of the foregoing ribbon/printing paper cartridge 1 and the foregoing video printer 47 are denoted by the same reference characters and the description thereof will be omitted.

Case (FIGS. 16 to 21)

A case 137 is constructed by joining together an upper half case 138 and a lower half case 139, and has a main body 140, a first cover 142 for covering the opening of a spool chamber 141 formed in the front one part of the main body 140, and a second cover 145 for covering a paper feed opening 144 formed in the top wall 143 of the main body 140. The case 137 has the shape of a comparatively flat, substantially square box.

Main Body

The main body 140 has a bottom wall 146 having the shape of a square plate, and a top wall 143 having a shape substantially resembling the letter U opening to the front. The opposite lateral end portions of the front edge of the top wall 143 are behind the front edge of the bottom wall 146 and the middle portion of the front edge of the top wall 143 is recessed. The front wall 147 of the main body 140 extends along the substantially U-shaped front edge of the top wall 143 to define the spool chamber 141 in front of the front wall 147. The front portion, upper portion and front halves of the side portions of the spool chamber 141 are open.

Longitudinal, parallel spool support walls 148 extend upright from the bottom wall 146. The back halves of the spool support walls 148 serve as the lower halves of the opposite lateral end walls of a back half portion 141*a* of the spool chamber 141. Substantially U-shaped recesses 148*a* and 148*b* are formed in the upper edges of the back halves of the spool support walls 148, respectively.

Spool support walls 149 extend downward from the top wall 143 so as to correspond to the back halves of the spool support walls 148, respectively, and small projections 149*a* project from the lower edges of the spool support walls 149. When the upper half case 138 and the lower half case 139 are joined together so that the upper edges of the spool support walls 148 of the lower half case 139 and the corresponding lower edges of the spool support walls 149 of the upper half case 138 are in close contact with each other, the projections 149*a* are fitted in the upper ends of the back recesses 148*a* to form spool support holes 150 for rotatably receiving a ribbon winding spool.

Longitudinal, parallel partition walls 151 are formed in the main body 140. Each partition wall 151 has a front end joined to the back surface of the front wall 147 at a position slightly inside the back half portion 141*a* of the spool chamber 141, and a back end joined to the inner surface of the back wall 152 of the main body 140. The partition walls 151, the front wall 147, the back wall 152, the bottom wall 146 and the top wall 143 define a printing paper chamber 153 for containing the pile 7 of printing papers. The front portion of the top wall 143 of the printing paper chamber 153 is recessed to define a rectangular paper feed opening 144 by the U-shaped front edge of the top wall 143 and the upper edge of the front wall 147. A paper lifting plate 40 is provided in the printing paper chamber 153.

A longitudinal slot 146*a* is formed in the bottom wall 146 along the lower edge of the left spool support wall 148 on the right-hand side of the spool support wall 148. The front end of the slot 146*a* opens in the front edge of the bottom wall 146.

The rest of the components of the main body 140 will be described later.

First Cover

The first cover 142 is an integral part comprising an upper portion 154 fitting to the upper surface, front surface and the opposite lateral surfaces of the spool chamber 141, a front portion 155, opposite lateral end portions 156, spool holding walls 157 extending downward from lower surface of the upper portion 154 at positions near the opposite lateral ends of the front half of the main portion 154, respectively, and legs 158 projecting downward from the opposite lateral ends of the back end of the upper portion 154. Small projections 157*a* are formed in the middle portions of the lower edges of the spool holding walls 157, respectively, and recesses 158*a* opening downward having a shape substantially resembling a keyhole are formed in the lower edges the legs 158.

Small pins 159 project outward from the upper portions of the back ends of the spool support walls 149, respectively, so as to be received rotatably in the substantially circular upper portions of the recesses 158*a* of the legs 158, respectively.

The first cover 142 is thus supported for vertical swing motion on the pins 159. When the first cover 142 is placed at a closed position with its lower edge seated on the bottom wall 146 as indicated by continuous lines in FIG. 21, the open surfaces of the spool chamber 141 are covered with the first cover 142, the lower edges of the spool holding walls 157 of the first cover 142 and the upper edges of the front halves of the spool support walls 148 are joined, and the projections 157*a* of the spool holding walls 157 are fitted in the recesses 148*b* of the spool support walls 148, respectively.

Second Cover

The second cover 145 has a flat main portion 160 of a size substantially equal to that of the paper feed opening 144, small legs 161 projecting downward from the back ends of the opposite side edges of the main portion 160, respectively, and a locking projection 162 projecting downward from a position near the front end of the right edge of the main portion 160. The legs 161 are provided with recesses 161*a* having the shape of a keyhole, and the locking projection 162 is provided with a locking hole 162*a*. A comparatively large recess 160*a* is formed in the front edge of the main portion 160.

Pins 163 project outward from the partition walls 151 of the case 137 at positions near the back end of the paper feed opening 144 and near the upper edges of the partition walls 151, respectively. The pins 163 are received in the upper portions of the recesses 161*a* of the legs 161, respectively, so that the second cover 145 is able to swing on the pins 163.

Figure 20:
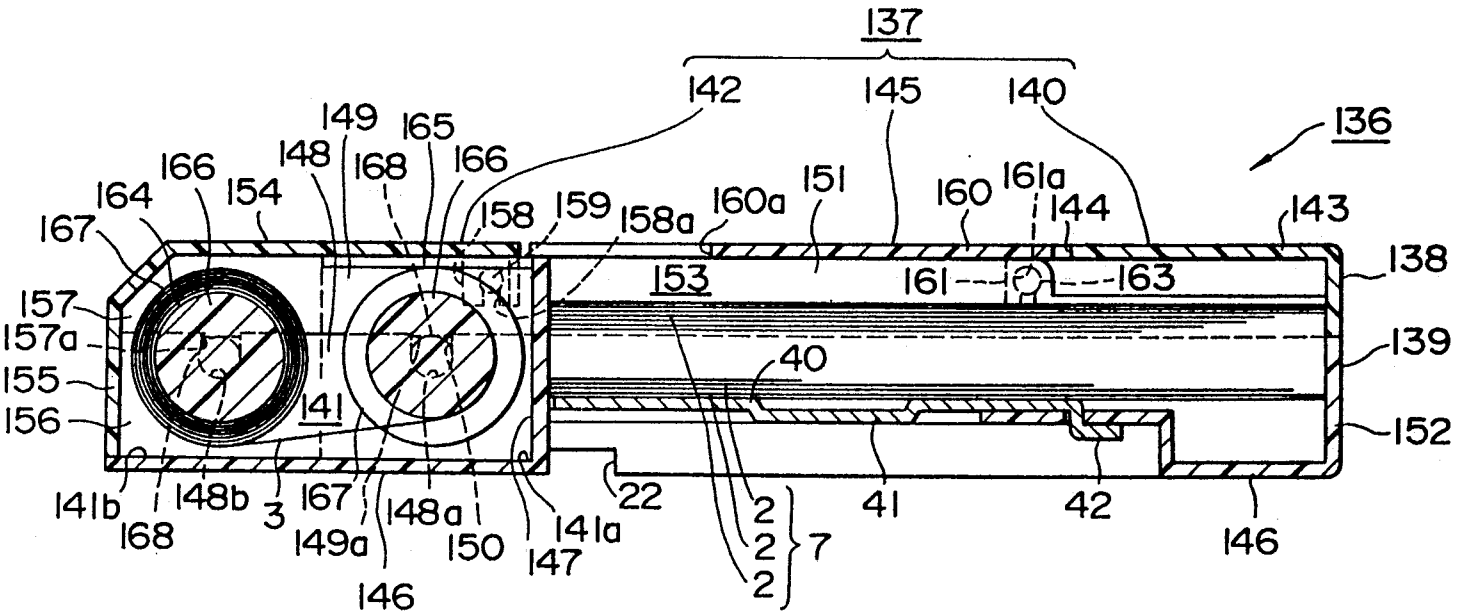
Figure 21:
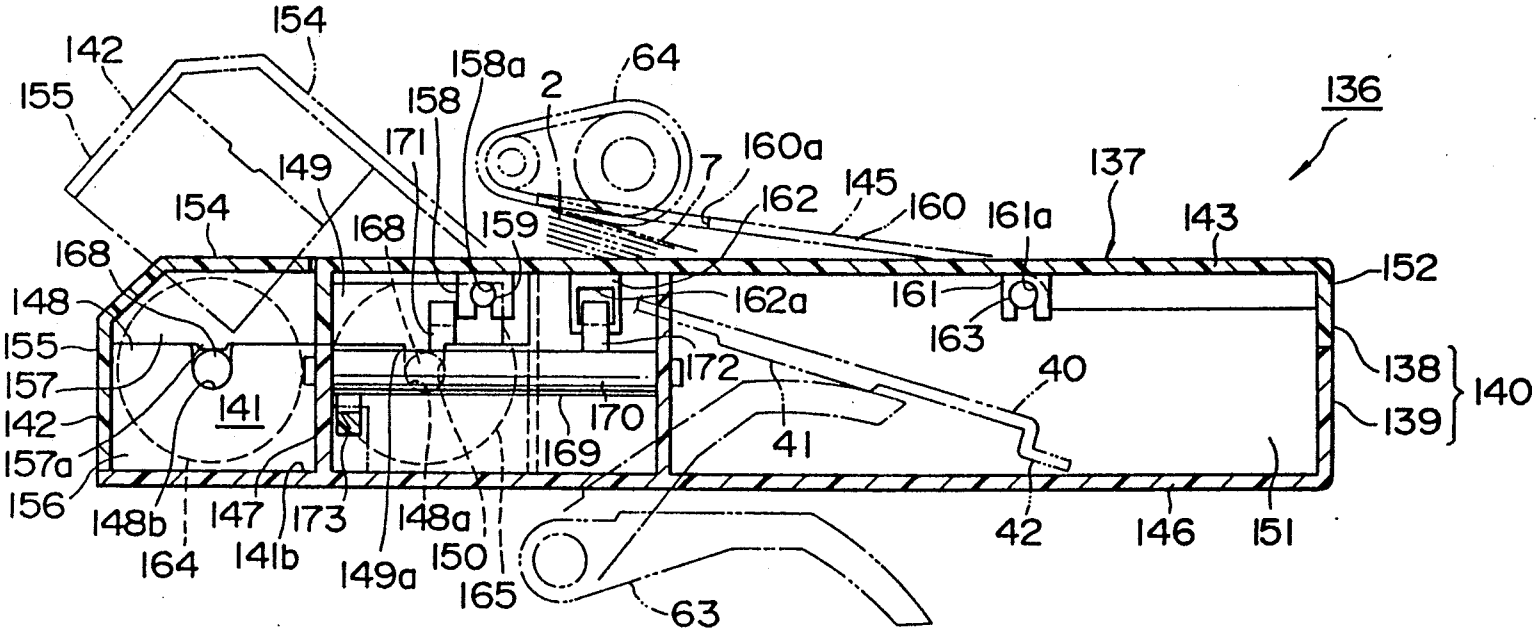
Figure 22:
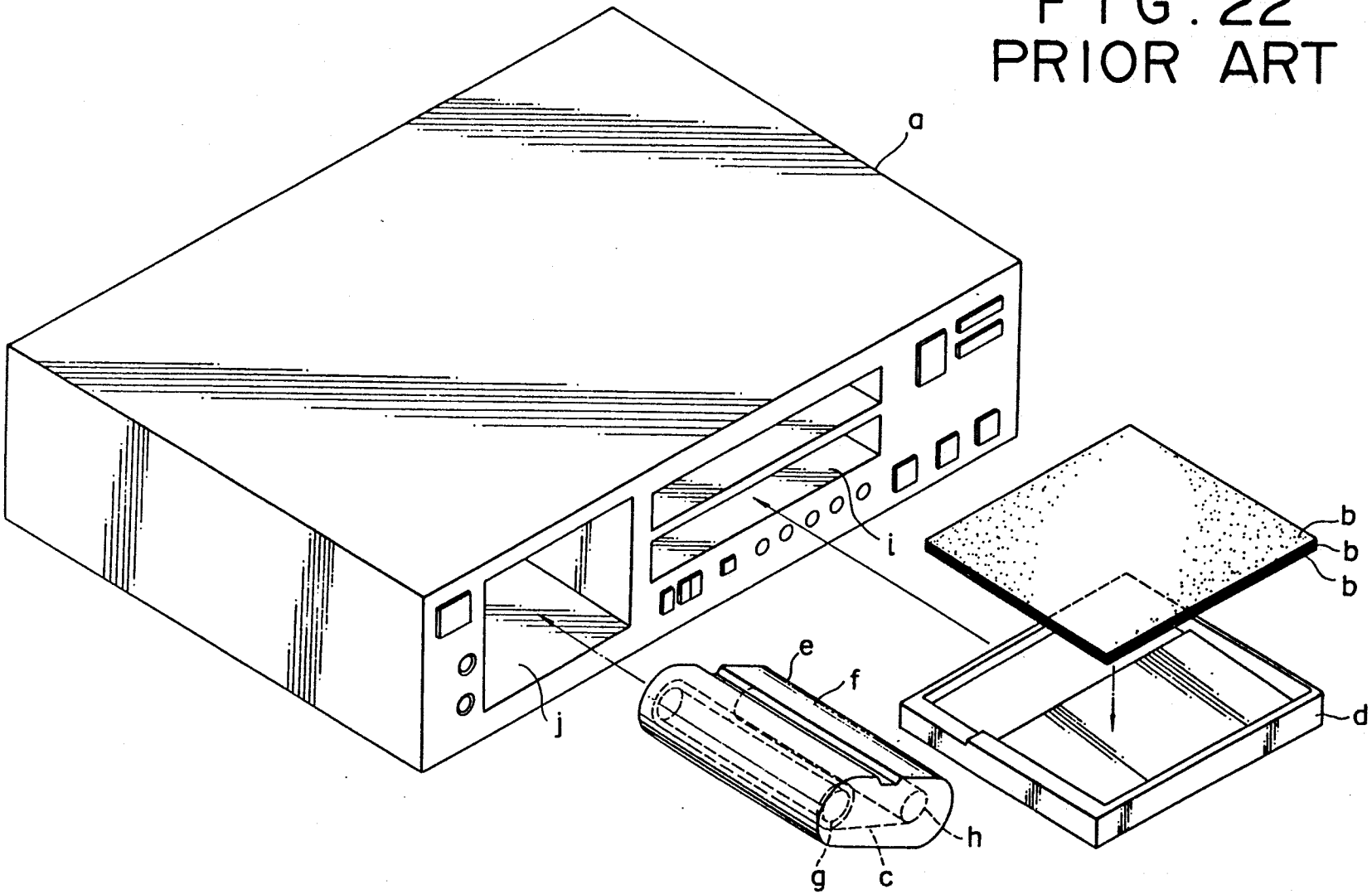
FIG. 22 PRIOR ART
FIG. 22 is a perspective view of a conventional video printer, and printing papers and ink ribbon cartridge for use in combination with the video printer.

Thus, the second cover 145 is supported for vertical swing motion on the pins 163. When the second cover 145 is placed at a closing position with the opposite lateral portions thereof seated on the upper edges of the partition walls 151, respectively, as shown in FIG. 20, the paper feed opening 144 is covered with the second cover 145.

Spools (FIGS. 16 to 21)

A ribbon feed spool 164 and a ribbon winding spool 165 have each a cylindrical spindle 166, two flanges 167 formed on the spindle 166 near the opposite ends of the same, and pivots 168 projecting from the opposite ends of the spindle 166 coaxially with the spindle 166. Gears 166*a* are formed on the left ends of the spindles 166 of the ribbon feed spool 164 and the ribbon winding spool 165, respectively.

An ink ribbon 3 is wound on the spindle of the ribbon feed spool 164 between the flanges 167. The leading end of the ink ribbon 3 is fastened to the spindle 166 of the ribbon winding spool 165 between the flanges 167.

The ribbon winding spool 165 is contained in the back half portion 141*a* of the spool chamber 141 with the pivots 168 thereof received rotatably in the spool support holes 150 formed in the case 137. The ribbon feed spool 164 is contained detachably in the front half portion 141*b* of the spool chamber 141 with the pivots 168 thereof received in the recesses 148*b* formed in the spool support walls 148, and the ribbon feed spool 164 is held in place by the projections 157*a* formed on the spool holding walls 157 of the first cover 142.

The lower portion of the gear 166*a* of the ribbon winding spool 165 protrudes downward through the back half portion of the slot 146*a* formed in the bottom wall 146 of the case 137.

Locking Member (FIGS. 16, 17, 19 and 21)

A locking member 169 has a longitudinally disposed cylindrical rod portion 170, two locking arms 171 projecting respectively from the middle and a position near the back end of the rod portion 170, and a projection 173 projecting from the rod portion 170 at a position near the front end of the same. The locking arms 171 and the projection 173 have shapes substantially resembling the letter L as viewed from the front. The locking arms 171 and 172, and the projection 173 project in opposite directions, respectively.

Figure 16:
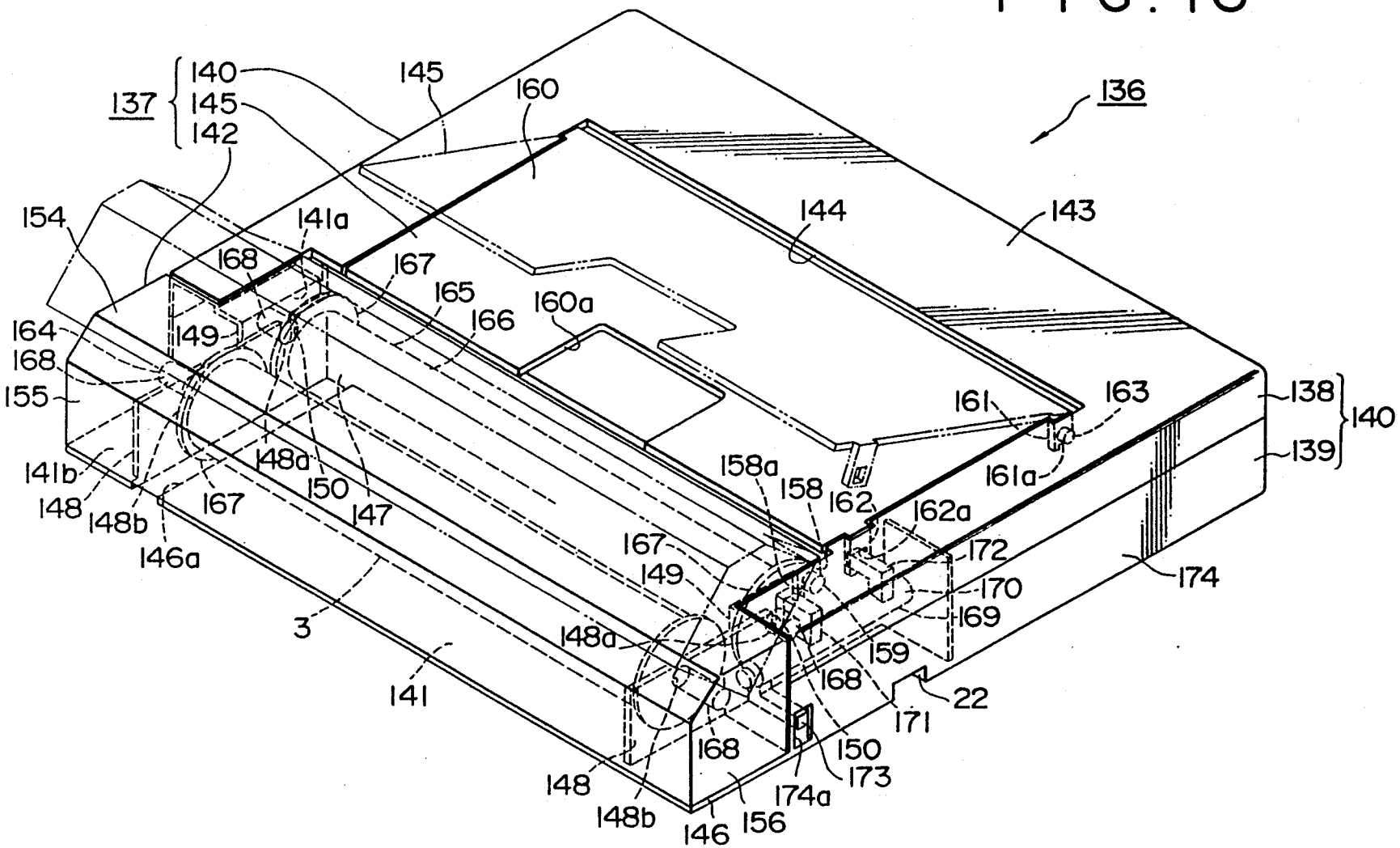
Figure 17:
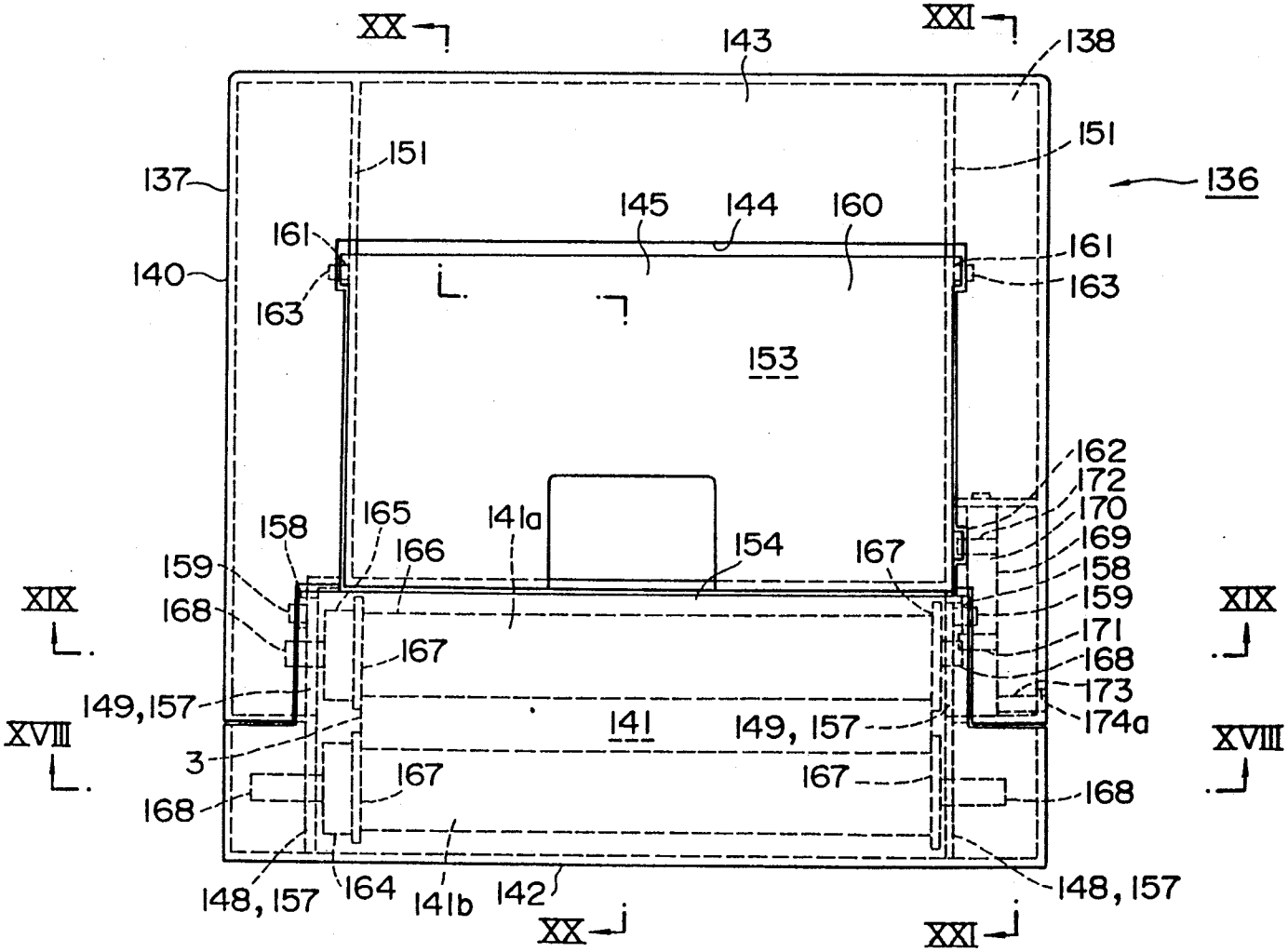
Figure 18:
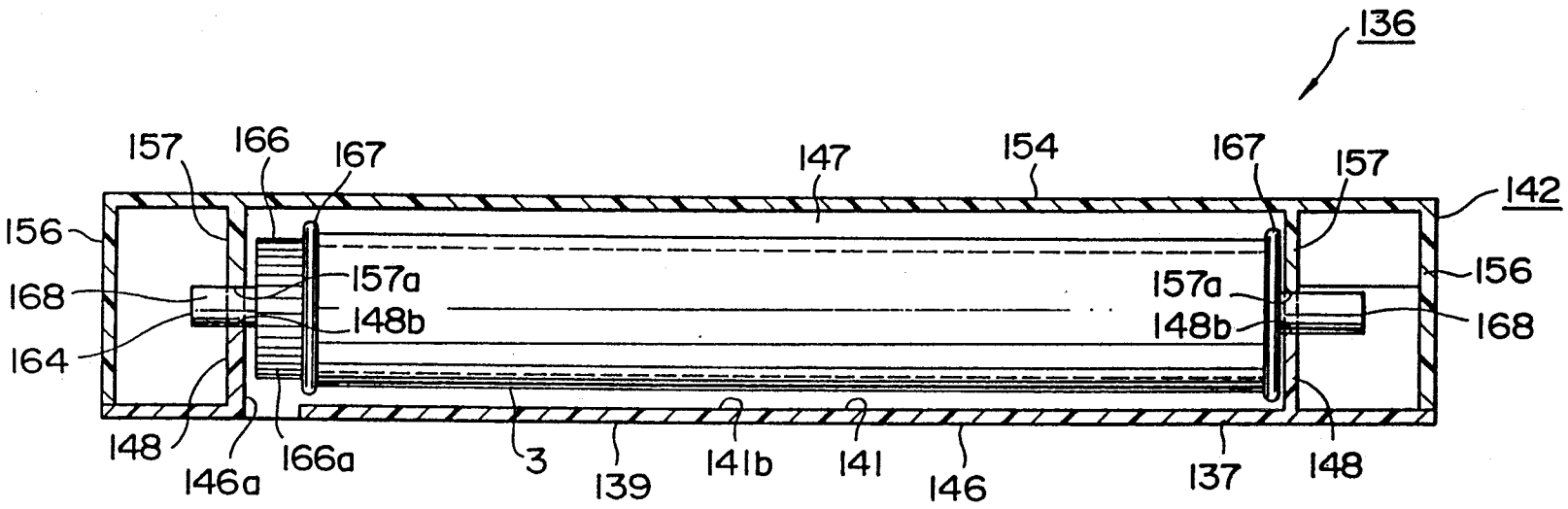
Figure 19:
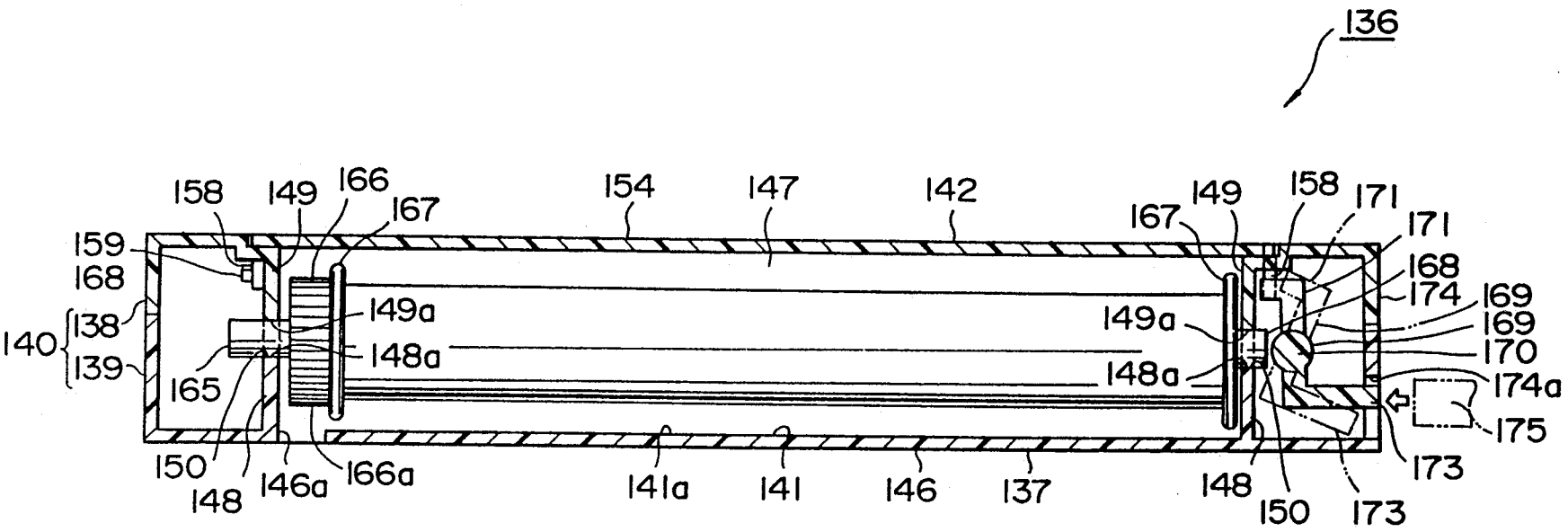

The locking member 169 is supported for rotation about the axis of the rod portion 170 in the main body 140 of the case 137 in a space on the right-hand side of the spool chamber 141 and the printing paper chamber 153. The locking member 169 is biased counterclockwise, as viewed from the front, by resilient means not shown. When the ribbon/printing paper cartridge 136 is not put in a printer, the extremity of the front locking arm 171 (hereinafter, referred to as the "first locking arm") is in contact with or located near the front surface of the right leg 158 of the first cover 142, the extremity of the back locking arm 172 (hereinafter, referred to as "second locking arm") engages the locking hole 162*a* of the locking projection 162 of the second cover 145, and the extremity of the projection 173 is located in a through hole 174*a* formed in the right-hand side wall 174 of the main body 140 of the case 137 as shown in FIG. 16.

In this state, the right leg 158 of the first cover 142 and the locking projection 162 of the second cover 145 are restrained from clockwise turning, as viewed from the right side, to lock the first cover 142 and the second cover 145 respectively at the closed positions.

When the ribbon/printing paper cartridge 136 is loaded on the printer, an unlocking member 175 (FIG. 19) provided on the printer is projected through the through hole 174*a* into the case 137 pushing the projection 173 of the locking member 169 to the left. Consequently, the locking member 169 is turned to a position indicated by alternate long and two short dashes lines in FIG. 19 to move the extremities of the locking arms 171 and 172 to the right, so that the covers 142 and 145 are unlocked.

Subsequently, the first cover 142 is turned upward through a predetermined angle by cover opening means, not shown, to a position indicated by alternate long and two short dashes lines to open the spool chamber 141. Then, the ribbon feed spool 164 is taken out from the case to load the printer with the ink ribbon 3.

In response to a paper feed command, the paper lifting plate 40 is lifted up by the lifting arm 63 to lift up the pile 7 of printing papers 2 and the second cover 145 so that the top printing paper of the pile 7 is pressed through the recess 160*a* formed in the main portion 160 of the second cover 145 against a paper feed belt 64, and then the paper feed belt 64 draws out the printing paper 2 from the case 137. When the ribbon/printing paper cartridge 136 is loaded on the printer, the gear a of the ribbon winding spool 165 and a ribbon winding gear are engaged through the slot 146*a* formed in the bottom wall 146.

In response to a cartridge ejection command, the ribbon feed spool 164, which has been taken out of the case 137, is returned into the spool chamber 141, the first cover 142 is moved to the closing position, the lifting arm 63 is returned to its initial position to allow the paper lifting plate 40 and the second cover 145 to move downward by gravity, the second cover returns to the closing position, and then the unlocking member 175 is retracted from the case 137 to allow the locking member 169 to be turned counterclockwise to lock the first cover 142 and the second cover 145. Then, the ribbon/printing paper cartridge 136 is removed from the printer.

As is apparent from the foregoing description, a transfer/recording paper cartridge in accordance with the present invention comprises, in combination, a recording paper container containing recording papers, and a transfer paper container containing a transfer paper feed spool on which is wound transfer paper carrying inks to be transferred to the recording papers and a winding spool to which is fastened the leading end of the transfer paper. The transfer/recording paper cartridge is characterized in that an opening formed in the recording paper container is covered with a cover, the cover is opened when the transfer/recording paper cartridge is loaded on a recording apparatus, and the paper feed means of the recording apparatus is brought into contact with the recording paper after the cover has been opened.

Furthermore, a transfer/recording paper cartridge in accordance with the present invention comprises, in combination, a recording paper container containing recording papers, and a transfer paper container containing a transfer paper feed spool on which is wound an inked transfer paper and a winding spool to which is fastened the leading end of the inked transfer paper, and is characterized by locking grooves capable of engaging locking members of a recording apparatus.

Accordingly, the transfer/recording paper cartridge in accordance with the present invention enables handling recording papers of a predetermined kind and a transfer paper pertaining to the recording papers always in combination, enables loading a recording apparatus to be loaded with both the recording papers and the transfer paper simply by receiving the transfer/recording paper cartridge. Since the recording papers are loaded on the recording apparatus with their right surfaces facing the right direction, the preparatory work can very easily be completed. Furthermore, since at least the opening of the recording paper container is covered with a cover, the recording papers are protected surely from being touched by the fingers, which enables handling the recording papers without any particular attention. Since the recording papers and the pertaining transfer paper are handled always in correct combination, unsatisfactory printing attributable to the wrong combination of recording papers and a transfer paper can surely be prevented. Since the remnant recording papers and the remnant transfer paper are always proportional, the recording papers and the transfer paper are not wasted.

The cover of the transfer/recording paper cartridge in the first embodiment, designed so as to be moved in directions parallel to the direction of movement of the transfer/recording paper cartridge relative to the recording apparatus requires a cover opening means of a simple construction.

The transfer/recording paper cartridge in the second embodiment is provided with a cover for covering the transfer paper container in addition to the cover for covering the recording paper container, and the covers are locked in a closed state by a locking member when the transfer/recording paper cartridge is not used. Therefore, both the recording papers and the transfer paper are protected surely from being touched by a user's fingers.

Furthermore, since the transfer/recording paper cartridge is provided with the locking grooves that engage the locking members of the recording apparatus, the position of the transfer/recording paper cartridge relative to the moving member can be fixed, and hence the transfer/recording paper cartridge can automatically and correctly be placed at a predetermined position in the recording apparatus by the automatic loading mechanism including the moving member.

Although the locking grooves in the foregoing embodiment are formed in the outer surface of the bottom wall of the transfer/recording paper cartridge, the locking grooves may be formed in any position of the transfer/recording paper cartridge provided that recording paper feed operation and operation for taking out the ribbon feed spool or the ribbon winding spool from the transfer/recording paper cartridge can be achieved smoothly.

The recording apparatus in accordance with the present invention is capable of carrying out the paper feed operation even if the transfer/recording paper cartridge is inserted in the recording apparatus with its cover closed.

Thus, the recording apparatus of the present invention enables the transfer/recording paper cartridge to be placed at and to be removed from a predetermined position mechanically and very stably for satisfactorily reliable operation.

In the foregoing embodiments, the transfer/recording paper cartridge is transported to and placed at a predetermined position in the recording apparatus by the cartridge holder which is moved by the motor. However, the transfer/recording paper cartridge may be set at a predetermined position in the recording apparatus by manual operation without using such a cartridge holder.

The resilient means employed in the foregoing embodiment for holding the cartridge holder in place at the loading position enables the transfer/recording paper cartridge to be loaded more stably on the recording apparatus.

Although the present invention has been described as applied to a video printer, and a ribbon/printing paper cartridge to be used in combination with the video printer by way of example, the present invention is not limited thereto in its practical application and may be applied to various recording apparatus which use a transfer paper and recording papers for recording and to transfer/recording paper cartridges for use in combination with such recording apparatus.

While the present invention has been described in its preferred embodiments, the shapes and constructions concretely described herein are illustrative and not restrictive and are not intended to limit the technical scope of the present invention.

What is claimed is:

1. A recording apparatus for forming an image on a recording paper, comprising:

a) a transfer/recording paper cartridge integrally having a recording paper container containing recording papers, and a transfer paper container containing a feed spool on which is wound a transfer paper and a winding spool to which is fastened the leading end of the transfer paper;

b) a cartridge holder removably holding the transfer/recording paper cartridge and capable of being moved between an ejecting position where the transfer/recording paper cartridge is inserted therein or removed therefrom, and a predetermined loading position;

c) locking means for locking the transfer/recording paper cartridge on the cartridge holder;

d) moving means for moving the cartridge holder to the loading position; and e) a support frame supporting the component;

wherein said support frame has support plates provided with guide slots, and said cartridge holder further comprises:

a bottom plate provided with stopper lugs with which the transfer/recording paper cartridge is brought into contact;

two side plates provided respectively along the opposite side edges of the bottom plate; and guide pins projecting from the outer surfaces of the side plates so as to slide along the guide slots.

2. A recording apparatus according to claim 1, wherein said transfer/recording paper cartridge has locking grooves that engage said locking means.

3. A recording apparatus according to claim 1, wherein said moving means comprises:

a) two arms provided with slots slidably receiving guide pins provided on said cartridge holder;

b) a shaft for synchronously turning the two arms;

c) a motor for driving the shaft to turn the two arms; and to the arms.

d) a gear train for transmitting the driving force of the motor to the arms.

4. A recording apparatus for forming an image on a recording paper, comprising:

a) a transfer/recording paper cartridge integrally having a recording paper container containing recording papers, and a transfer paper container containing a feed spool on which is wound a transfer paper and a winding spool to which is fastened the leading end of the transfer paper;

b) a cartridge holder removably holding the transfer/recording paper cartridge and capable of being moved between an ejecting position where the transfer/recording paper cartridge is inserted therein or removed therefrom, and a predetermined loading position;

c) locking means for locking the transfer/recording paper cartridge on the cartridge holder;

d) moving means for moving the cartridge holder to the loading position; and e) a support frame supporting the component;

wherein said support frame has support plates provided with guide slots, said locking means further comprises locking levers pivotally supported on said cartridge holder so as to be moved together with said cartridge holder;

first guide pins provided on the locking levers so as to slide along the guide slots; and locking fingers provided on the locking levers so as to engage the transfer/recording paper cartridge.

5. A transfer/recording paper cartridge for insertion into a recording apparatus, said transfer/recording paper cartridge integrally having a recording paper container containing recording papers, and a transfer paper container containing a transfer paper carrying an ink to be transferred to the recording paper, said transfer/recording paper cartridge comprising:

a) a case having the recording paper container and the transfer paper container, and provided with a paper feed opening for receiving a paper feed means of a recording apparatus when loaded on a recording apparatus;

b) a predetermined number of recording papers contained in a pile in the recording paper container;

c) a transfer paper contained in the transfer paper container and carrying an ink to be transferred to the recording paper;

d) a ribbon feed spool on which is wound the transfer paper;

e) a ribbon winding spool to which is fastened the leading end of the transfer paper; and f) a cover for closing the paper feed opening of the case;

wherein said cover slides in a direction parallel to the direction of insertion of the transfer/recording paper cartridge in a recording apparatus to open the paper feed opening;

g) elastic members for biasing said cover in a direction to close the paper feed opening;

h) spring pegs provided on side legs of said cover each for holding at least one of said elastic members one end thereof;

i) spring pegs provided on inside peripheral walls of said case each for holding at least one of said elastic members at the other end thereof; and j) a flange provided on a front edge of said cover so as to engage a cover opening member of a recording apparatus.

6. A transfer/recording paper cartridge integrally having a recording paper container containing recording papers, and a transfer paper container containing a transfer paper carrying an ink to be transferred to the recording paper, said transfer/recording paper cartridge comprising:

a) a case having the recording paper container and the transfer paper container, and provided with locking grooves so as to engage a case transfer member of a recording apparatus;

b) a predetermined number of recording papers contained in a pile in the recording paper container;

c) a transfer paper contained in the transfer paper container and carrying an ink to be transferred to the recording paper;

d) a feed spool on which wound the transfer paper; and e) a winding spool to which is fastened the leading end of the transfer paper.

* * * * *